United States Patent [19]

Fujisawa et al.

[11] Patent Number: 5,038,139

[45] Date of Patent: Aug. 6, 1991

[54] HALF TONE DISPLAY DRIVING CIRCUIT FOR CRYSTAL MATRIX PANEL AND HALF TONE DISPLAY METHOD THEREOF

[75] Inventors: Kazuhiro Fujisawa, Fujisawa; Hiroyuki Mano, Yokohama; Satoru Tsunekawa, Tachikawa; Kiyoshige Kinugawa, Chiba; Satoshi Konuma, Yokohama; Tatsuhiro Inuzuka, Kamakura, all of Japan

[73] Assignee: Hitachi, Ltd., Japan

[21] Appl. No.: 395,595

[22] Filed: Aug. 18, 1989

[30] Foreign Application Priority Data

Aug. 29, 1988 [JP] Japan ..... 63-212488

[51] Int. Cl.[5] ..... G09G 3/36; G09G 3/00

[52] U.S. Cl. ..... 340/784; 340/793; 340/805; 340/767; 358/236

[58] Field of Search ..... 340/767, 784, 793, 805, 340/811; 358/236; 350/331 R, 332, 333

[56] References Cited

U.S. PATENT DOCUMENTS

| | | | |
|---|---|---|---|
| 4,511,926 | 4/1985 | Crossland et al. | 358/236 |
| 4,743,096 | 5/1988 | Wakai et al. | 340/793 |
| 4,748,510 | 5/1988 | Umezawa | 358/236 |
| 4,775,891 | 10/1988 | Aoki | 340/784 |
| 4,779,083 | 10/1988 | Ishii et al. | 340/769 |
| 4,795,239 | 1/1989 | Yamashita et al. | 340/784 |
| 4,857,906 | 8/1988 | Conner | 340/784 |
| 4,859,998 | 8/1989 | Kawamura et al. | 340/793 |

*Primary Examiner*—Jeffery A. Brier
*Assistant Examiner*—M. Fathi-yari

[57] ABSTRACT

In a half tone display driving circuit for a liquid crystal matrix panel, a pulse for half tone display is phase modulated so that pulse signals which are out of phase relative to each other are applied to adjacent columns of the liquid crystal matrix panel, or from the phase-modulated pulse a gray scale pulse (tone pulse) is prepared in which the frequency of occurrence of voltage edges is decreased. The dephased pulse signals or the gray scale pulse (tone pulse) is used to prevent a decrease in brightness of display when the liquid crystal matrix panel is driven for half tone display.

14 Claims, 32 Drawing Sheets

| INPUT | OUTPUT | | |
|---|---|---|---|
| Dj | $Dj_1$ | $Dj_2$ | $Dj_3$ |
| 0 | 1 | 0 | 0 |
| 1 | 0 | 1 | 0 |
| 2 | 0 | 0 | 1 |

HALF TONE DISPLAY DRIVING CIRCUIT FOR CRYSTAL MATRIX PANEL AND HALF TONE DISPLAY METHOD THEREOF

BACKGROUND OF THE INVENTION

The present invention relates to a half tone display driving circuit for a crystal matrix panel and a half tone display method therefor.

In a conventional half tone display driving circuit for a crystal matrix panel, as described in JP-A-50-156396, the half tone display is effected by changing the time duration of application of voltages to a signal line and a scanning line of the liquid crystal matrix panel to change effective voltage applied to the liquid crystal. When in this conventional method the number of points at which half tone of the same degree is displayed is large, the frequency of voltage switching operations effected simultaneously on signal lines increases and noises are induced scanning lines by way of the liquid crystal, raising a problem that the effective voltage applied to the liquid crystal is decreased to decrease brightness of display.

The half tone display driving circuit for a crystal matrix panel will be detailed with reference to FIGS. 2 to 17.

FIG. 2 shows an example of a liquid crystal display apparatus having ability to display half tone.

Referring to FIG. 2, reference numeral 1 designates display data, 2 a shift clock serving as a synchronization clock for the display data 1, and 3 a horizontal clock for defining the interval of one horizontal period. Reference numeral 4 designates a display data shift register for storing an amount of data pieces of display data 1 for one horizontal period and reference numeral 5 generally represents horizontal display data pieces Dl to Dn contained in the display data 1 for one horizontal period stored in the display data shift register 4. Reference numeral 6 designates a decoder and 7 generally represents sets of data pieces $D_{11}$ $D_{12}$ $D_{13}$ to $Dn_1$ $Dn_2$ $Dn_3$ which are delivered out of the decoder 6 to serve as select signals. Reference numeral 8 represents a clock GCLK which has two cycles within one horizontal period. Reference numeral 9 designates a ½ pulse generator for generating a pulse the duration of which is half of one horizontal period and 10 a ½ duration pulse (hereinafter simply referred to as ½ pulse) delivered out of the ½ pulse generator. Reference numeral 11 designates a selector and 12 generally represents output signals Xl to Xn of the selector 11 which serve as column selection signals. Reference numeral 13 designates a line head clock and 14 a vertical shift register which receives the line head clock 13 to shift the data in accordance with the horizontal clock 3. Reference numeral 15 generally represent output signals Yl to Ym of the vertical shift register 14 which serve as line or row selection signals. Reference numeral 16 designates a voltage Va and 17 a voltage Vb, the Va and Vb voltages 16 and 17 being positive and the former being higher than the latter. Reference numerals 18 designates a column liquid crystal driver, 19 generally represents output signals $V_{xl}$ to $V_{xn}$ of the column liquid crystal driver 18 which serve as column driving signals. Reference numeral 20 designates a line or row liquid crystal driver and 21 generally represents output signals $V_{yl}$ $V_{ym}$ of the row liquid crystal driver 20 which serve as row driving signals. Denoted by 22 is a liquid crystal panel.

FIG. 4 shows the interior of the decoder 6 in which decoders 23 are provided.

FIG. 5 shows a truth table of the decoder 23.

FIG. 6 shows an internal circuit of ½ pulse generator 9 including a NOT circuit 24 for clock, a NOT circuit 25 for resetting, a D flip-flop with resetting 26 and a D flip-flop 27.

FIG. 7 is a timing chart for the ½ pulse generator 9.

FIG. 8 shows an internal circuit of selector 11 including n stages each having AND circuits 28 to 30 and an OR circuit 31.

FIG. 9 is a timing chart of the operation of the vertical shift register 14.

FIG. 10 shows an internal circuit of column liquid crystal driver 18 including n stages each having a switching transistor 32 for Va, a switching transistor 33 for Vb and a NOT circuit 34.

FIG. 11 is a timing chart of the operation of the column liquid crystal driver 18.

FIG. 12 is a timing chart of the operation of the FIG. 2 apparatus.

FIG. 13 shows waveforms including those applied to the liquid crystal panel 22 when the FIG. 2 apparatus is operated at timings shown in FIG. 12.

FIG. 14 is a diagram useful in explaining the operational principle of the liquid crystal panel 22.

FIG. 15 is an equivalent circuit of the liquid crystal panel 22.

FIG. 16 shows a charging waveform appearing at a normal display point of the liquid crystal panel 22.

FIG. 17 shows a charging waveform appearing at a half tone display point of the liquid crystal panel 22.

The operation of the FIG. 2 apparatus will now be explained.

As shown in the timing chart of FIG. 3 data pieces of display data 1 inputted in synchronism with the shift clock 2 during one horizontal period ranging from a fall edge of the horizontal clock 3 to the succeeding fall edge thereof are fetched sequentially by the display data shift register 4. During the succeeding horizontal display period, a data piece, of the display data 1 fetched during the preceding horizontal display period, which is fetched at time $t_1$ (see FIG. 12) is delivered as output signal D1 of the horizontal display data 5, a data piece fetched at time $t_2$ is delivered as output signal D2, a data piece fetched at time $t_3$ is delivered as output signal D3 and similarly a data piece fetched at time tn is delivered as output signal Dn.

The decoder 6 receives the horizontal display data and decodes the data pieces Dl to Dn into sets of $D_{11}$ $D_{12}$ $D_{13}$ to $Dn_1$ $Dn_2$ $Dn_3$ which are delivered out of the decoder 6 as select signals 7.

As shown in FIG. 4, the decoder 6 includes the n decoders 23 which receive respectively one, Dj, of the data pieces Dl to Dn of the horizontal display data 5 and delivers one, $Dj_1$ $Dj_2$ $Dj_3$, of the sets $D_{11}$ $D_{12}$ $D_{13}$ to $Dn_1$ $Dn_2$ $Dn_3$ of the select signals 7 in accordance with the truth table shown in FIG. 5.

As shown in FIG. 6, the ½ pulse generator 9 includes the NOT circuits 24 and 25, D flip-flop with resetting 26 and D flip-flop 27.

In operation, the ½ pulse generator responds to the GCLK 8 and horizontal clock 3 to generate a ½ pulse 10 which has the first half of "high" and the second half of "low" during one horizontal period, as shown in the timing chart of FIG. 7.

The selector 11 responds to the sets $D_{11}$ $D_{12}$ $D_{13}$ to $Dn_1$ $Dn_2$ $Dn_3$ of the select signals 7 to selectively deliver "high" signal, ½ pulse 10 or "low" signal as individual output signals Xl to Xn of the column selection signals 12.

As shown in FIG. 8, the selector 11 includes n stages each having the three AND circuits 28 to 30 and the one OR circuit 31. Each stage operates to produce "low" signal as output signal Xj when $Dj_1$ "high", ½ pulse 10 as output signal Xj when $Dj_2$ is "high", and "high" signal as output signal Xj when $Dj_3$ is "high". A set of $Dj_1$ $Dj_2$ $Dj_3$ representative of output signals of the decoder 6 always contain only one "high" signal as will be seen from the FIG. 5 truth table of the decoder 6.

As shown in FIG. 10, the column liquid crystal driver 18 includes n stages each having the NOT circuit 34, Va switching transistor 32 and Vb switching transistor 33. The driver 18 is responsive to the column selection signals Xl to Xn to produce on output leads output signals $Vx_l$ to $Vx_n$ of the column driving signal 19, thereby providing voltages for driving the liquid crystal. The column liquid crystal driver 18 operates, as shown in FIG. 11, to deliver the voltage Va as output signal Vxj of column driving signals 19 which corresponds to one, Xj, of the column selection signals Xl to Xn when the input signal Xj is "1" but deliver the voltage Vb when the input signal Xj is "0".

The vertical shift register 14 operates, as shown in FIG. 9, to fetch a line head clock 13 at the timing of a fall edge of the horizontal clock 3 and deliver an output signal Y1 of the row selection signals 15 and thereafter it operates to shift to sequential delivery of output signals Y2, Y3, - - - Ym in synchronism with fall edges of the horizontal clock 3.

The row liquid crystal driver 20 structurally resembles the column liquid crystal driver 18 and operates to deliver $-Va$ to $V_{Yk'}$, one of output signals $V_{Yl}$ to $V_{Ym}$ to of row driving signals 21 which corresponds to $Y_k$, one of signals Yl to Ym of the row selection signal 15 when the Yk is "1" but deliver Vb when the Yk is "0".

The apparatus of FIG. 2 operates as shown in the operational timing chart of FIG. 12 when the input signal 1 contains data pieces "0", "1" and "2".

The data pieces "0", "1" and "2" of the input signal 1 sequentially inputted, beginning with a fall edge of a horizontal clock signal 3, are delivered as output signals D1, D2 and D3 of the horizontal display data 5 at the timing of a fall edge of the succeeding horizontal clock signal 3.

The horizontal display data 5 is decoded by the decoder 6 and select signals 7 are delivered therefrom which cause the selector 11 to select "high"signal, ½ pulse 10 or "low" signal so as to produce column selection signals 12 containing signal X1 of "low" level, signal X2 of ½ pulse 10 and signal X3 of "high" level.

The column liquid crystal driver 18 receives the column selection signals 12 to produce Vb as signal $Vx_1$, Va and Vb as signal $Vx_2$ during the first and second halves of one horizontal period, respectively, and Va as signal $Vx_3$.

On the other hand, the vertical shift register 14 receives the line head clock which rises during a horizontal period, within which the input signal 1 containing data pieces "0", "1" and "2" is inputted, and does not rise during the succeeding horizontal period. The line head clock is then latched by a fall edge of the horizontal clock signal to provide a "high" signal Y1 of the row selection signals 15. This "high" signal Y1 causes the row liquid crystal driver 20 to produce $-Va$ as signal $V_{Y1}$ of the row driving signal 21 and Vb as the other signals $V_{Y2}V_{Y3}$, - - - of the row driving signal 21.

When the apparatus operates at timings shown in FIG. 12, voltages are applied to the liquid crystal panel 22 at timings as shown in FIG. 13.

The liquid crystal panel 22 is constructed as shown in FIG. 14 and operates to transmit light when the potential difference between row driving signal 21 and column driving signal 19 is large (here, greater than $Va-Vb$) but intercept light when the potential difference is small (here, less than $Va-Vb$). Electrically, the liquid crystal has characteristics of capacitor, as shown in FIG. 15. Therefore, for $V_{X3}-V_{Y1}$ in FIG. 13, the liquid crystal is charged during one horizontal period as shown in FIG. 16. However, for $V_{X2}-V_{Y1}$ in FIG. 13, the liquid crystal is charged only during the first half of one horizontal period, with the result that the liquid crystal is not charged fully as shown in FIG. 17 to slightly transmit light, thereby effecting display of half tone.

Through the above operation, the half tone display can be accomplished.

Conventionally, the half tone display is realized by changing the pulse width but disadvantageously, with the number of the half tone display points of the same degree increased, noises are generated by simultaneous changes at edges of pulse signals to decrease brightness of display.

A decrease in brightness will now be explained with reference to FIGS. 18 to 20.

FIG. 18 shows waveforms ideally appearing when the half tone display is effected over a wide area of the liquid crystal panel 22.

FIG. 19 shows waveforms actually appearing when the half tone display is effected over the wide area of the liquid crystal panel 22.

FIG. 20 shows charging waveforms obtained with waveforms of FIGS. 18 and 19.

When the half tone display is effected over the wide area of the liquid crystal panel 22 in the FIG. 2 apparatus, the brightness is decreased as will be described below.

As shown in FIG. 18, data pieces "1" of display data 1 are sequentially inputted. Then, Va and Vb are produced as each of the signals $V_{Xl}$ to $V_{Xn}$ during the first and second halves of one horizontal period, respectively. On the other hand, the vertical shift register 14 first receives the line head clock 13 and thereafter shifts to sequentially produce $-Va$ as either one of signals $V_{Yl}$ to $V_{Ym}$ of the row driving signal 21 in synchronism with fall edges of the horizontal clock signals 3.

Through the above operation, voltage $V_{Xl}-V_{Yl}$ in FIG. 18 is applied to a crossing on the first row and the first column of the liquid crystal panel 22.

Practically, however, in the liquid crystal panel 22 having an electrical equivalent circuit as shown in FIG. 15, AC components are generated from all of the column driving signals 19 at voltage switching points to induce noises in the row driving signals 21, as shown in FIG. 19.

Consequently, the rise of the voltage applied to the liquid crystal of the liquid crystal panel gets blunted as shown at the righthand illustration in FIG. 20, with the result that the effective voltage applied to the liquid crystal panel 22 is decreased to decrease the brightness of display.

SUMMARY OF THE INVENTION

An object of the present invention is to prevent brightness of display from decreasing when the liquid crystal panel is driven to display half tone.

According to the present invention a half tone display driving circuit for a liquid crystal matrix panel has column liquid crystal driver means and row liquid crystal driver means for effecting display on the liquid crystal matrix panel, 1/n pulse generator means for generating a 1/n pulse for half tone display, and 1/n pulse signal processing means for processing the 1/n pulse for half tone display. In the half tone display driving circuit for a liquid crystal matrix panel according to the invention, the 1/n pulse for half tone display is processed by the 1/n pulse signal processing means, and the pulse signal subjected to the signal processing is selectively applied to the column liquid crystal driver means so as to prevent brightness of display from decreasing when the liquid crystal matrix panel is driven to display half tone.

Thus, the present invention is featured in that the 1/n pulse for half tone display is subjected to signal processing and selectively applied to the column liquid crystal driver means to prevent a decrease in brightness of display from occurring when the liquid crystal matrix panel is driven to display half tone. Specifically, the feature of the present invention may be realized in two major ways representing two embodiments.

In accordance with the first embodiment, the pulse for half tone display is subjected to phase modulation so that half tone display pulses which are out of phase relative to each other are applied to adjacent columns of the column liquid crystal driver means. For example, a rise edge of pulse and a fall edge of pulse are designed to occur at adjacent columns at the same timing in order that a noise due to the rise and a noise due to the fall are cancelled to prevent a decrease in brightness of the liquid crystal matrix panel when half tone display is effected.

In accordance with the second embodiment, a gray scale pulse (tone pulse) is prepared from the pulse for half tone display and the pulse resulting from phase modulation of the pulse for half tone display, and the tone pulse is applied to the column liquid crystal driver means so that the frequency of occurrence of voltage edges is decreased to prevent brightness of display from decreasing when the liquid crystal matrix panel is driven for half tone display.

The first manner of cancelling noises and the second manner of decreasing the frequency of occurrence of voltage edges may be used in combination to prevent a decrease in brightness of display from occurring when half tone display is effected.

DESCRIPTION OF THE PREFERRED EMBODIMENTS

The present invention will now be described by way of example with reference to the accompanying drawings.

Figure 45:
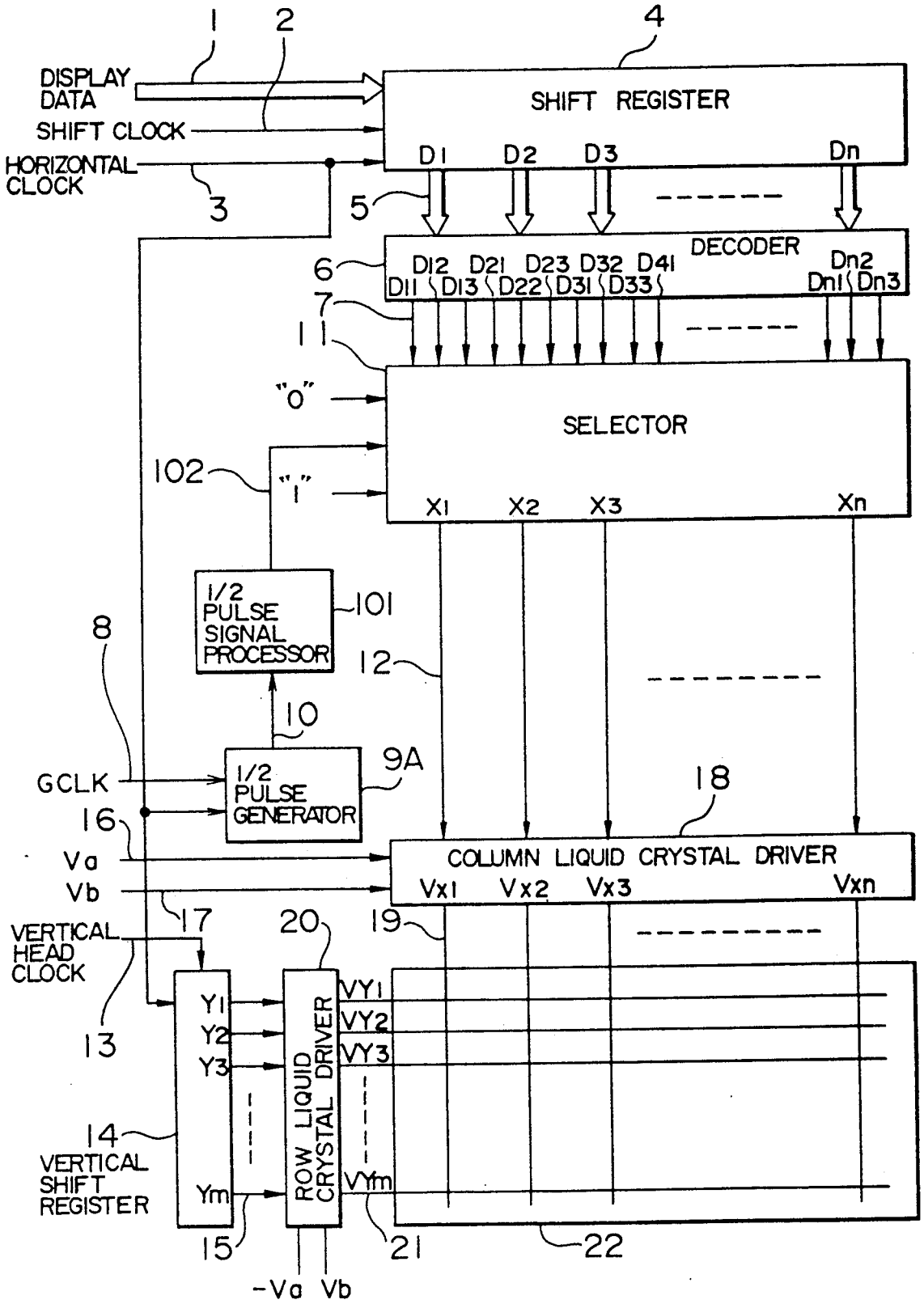
FIG. 45 is a block diagram useful in generally explaining the embodiments of the invention.

FIG. 45 is a useful in generally explaining embodiments of the invention.

Figure 2:
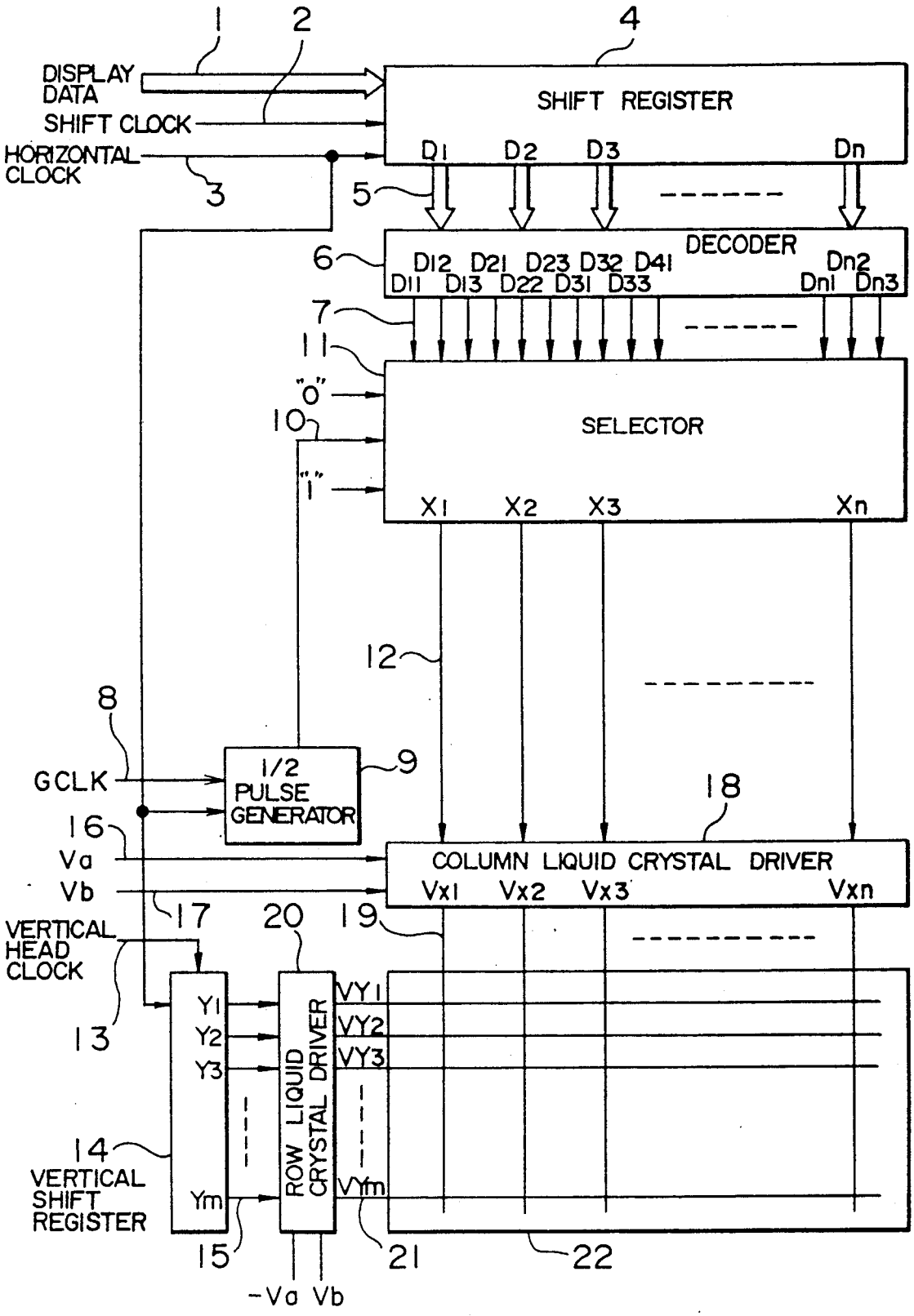
FIG. 2 is a block diagram useful to explain a half tone display driving circuit for a liquid crystal matrix panel.
Figure 3:
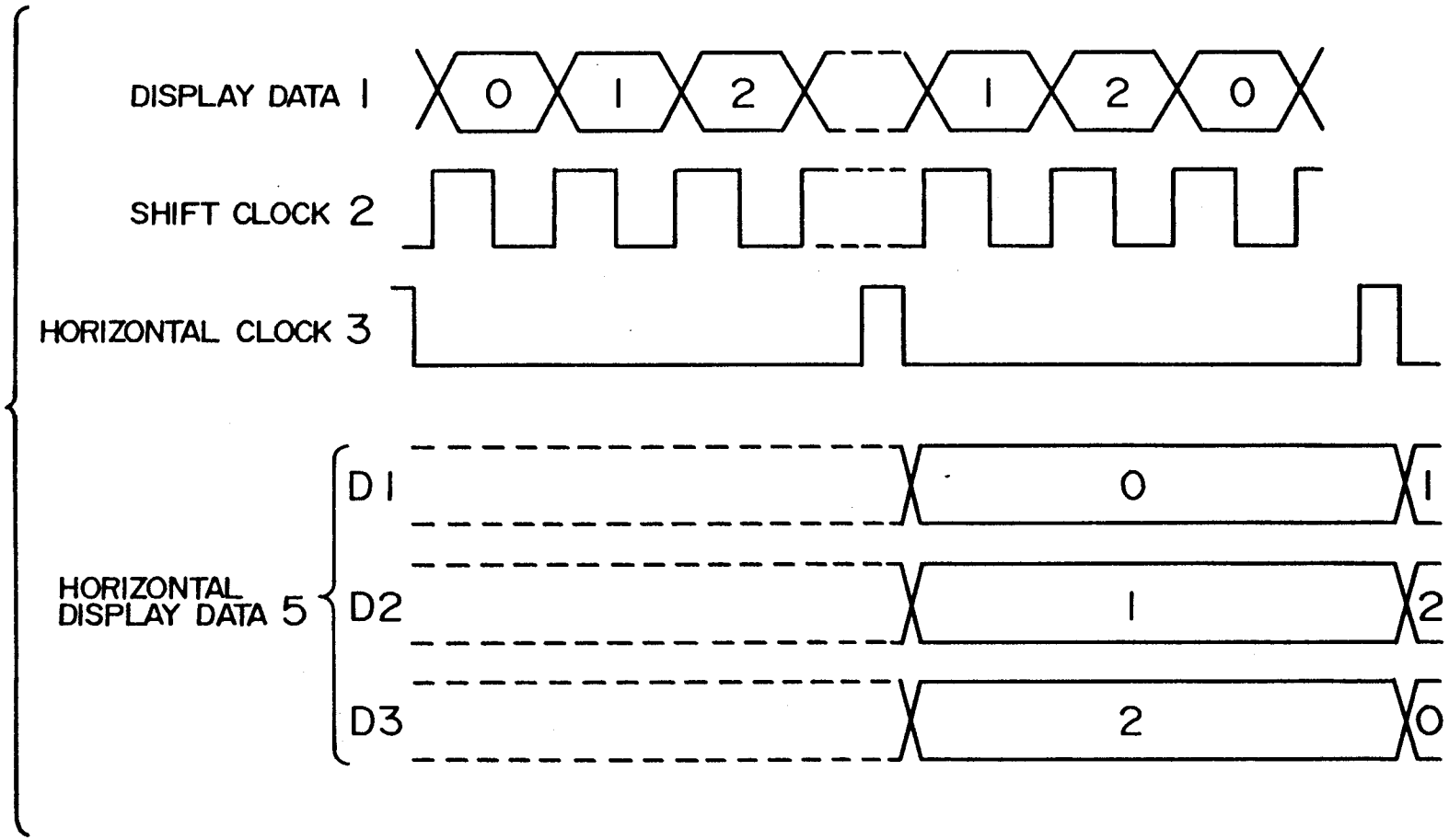
FIG. 3 is a timing chart for a display data shift register 4.
Figures 4, 5:
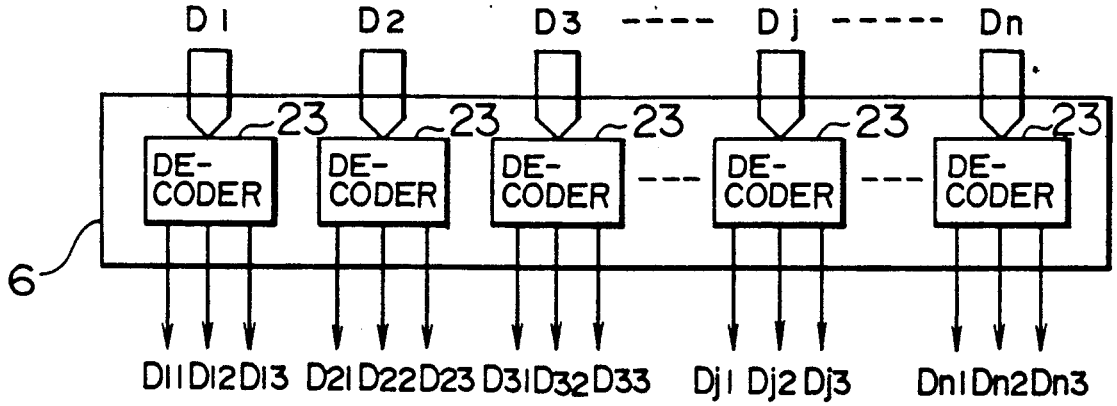
FIG. 4 is a block diagram showing the interior of a decoder 6.
FIG. 5 is a truth table of a decoder 23.
Figure 6:
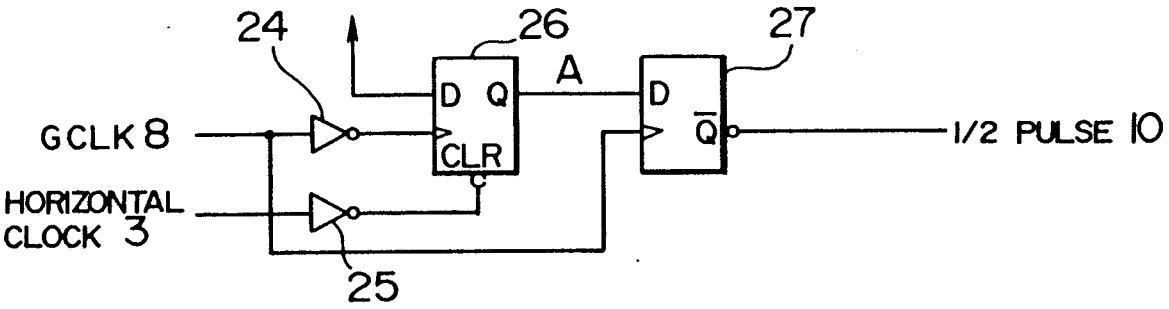
FIG. 6 is a circuit diagram of a ½ pulse generator 9.
Figure 8:
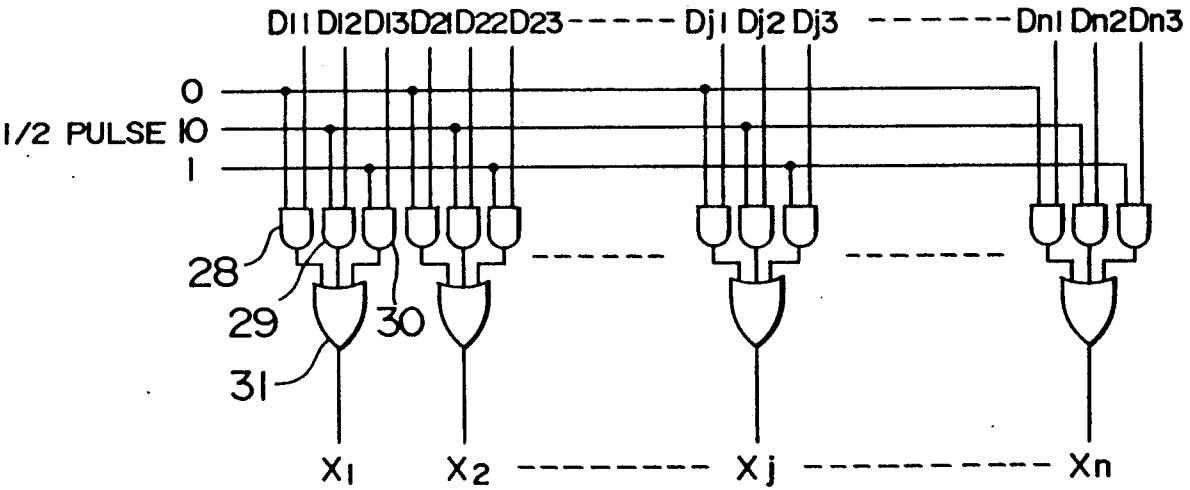
FIG. 8 is a circuit diagram of a selector 11.
Figure 7:
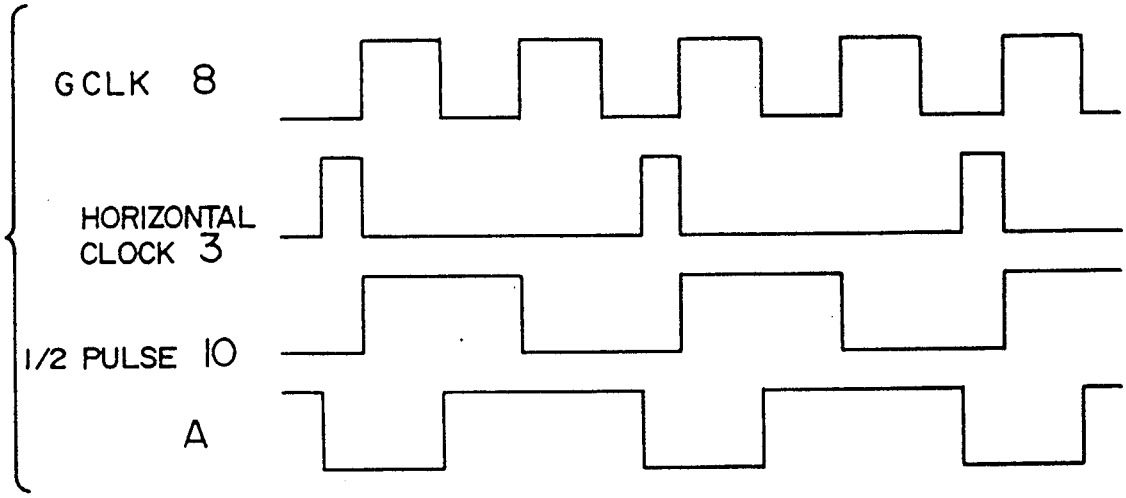
FIG. 7 is a timing chart for the ½ pulse generator.
Figure 9:
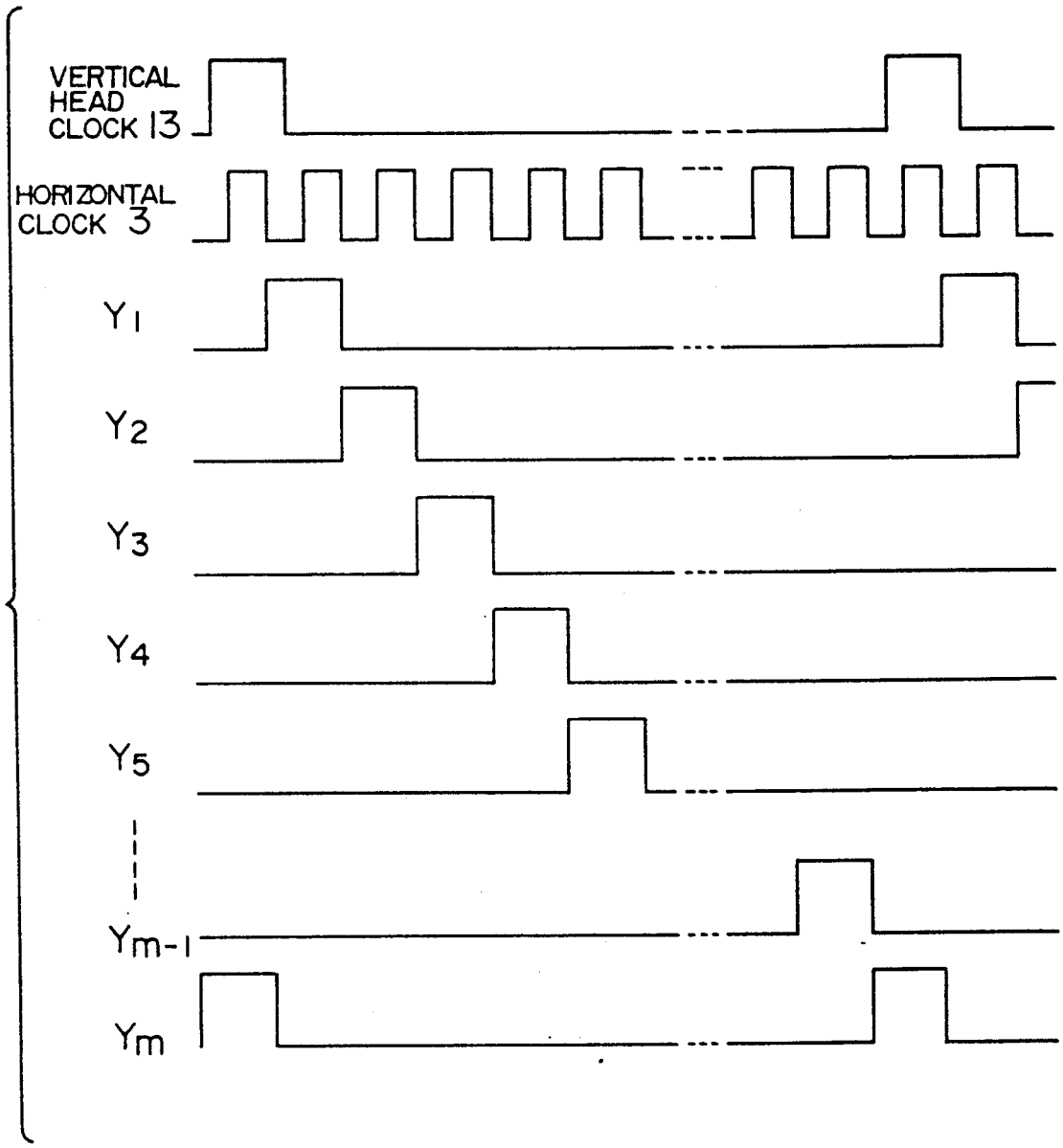
FIG. 9 is a timing chart of the operation of a vertical shift register 14.
Figure 10:
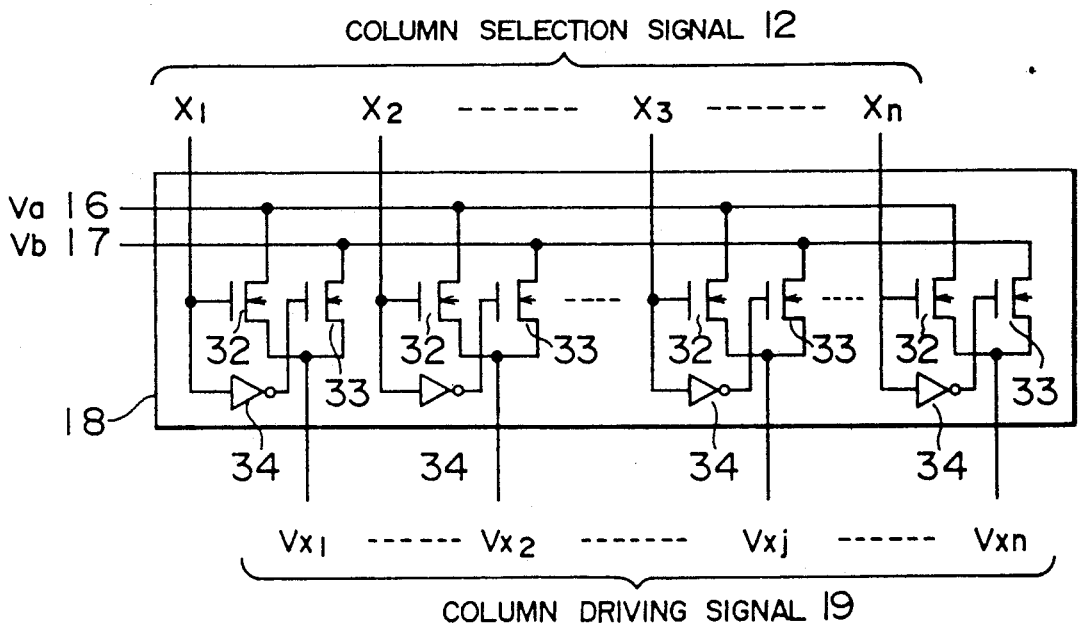
FIG. 10 is a circuit diagram of a column liquid crystal driver 18.
Figure 11:
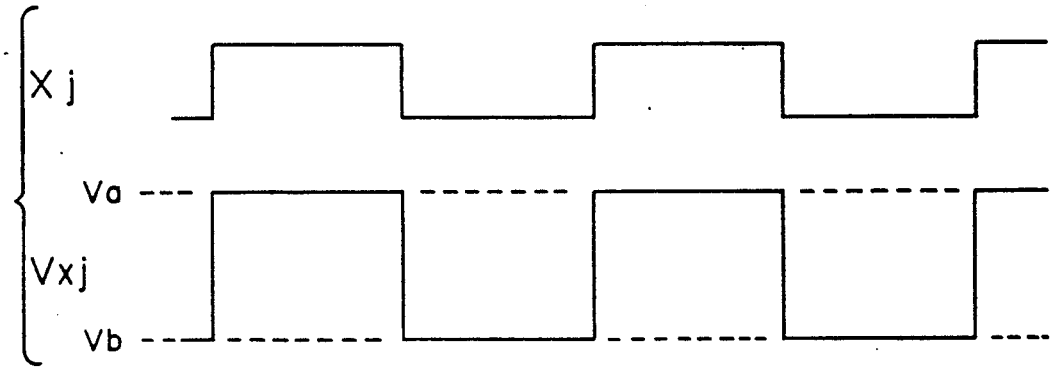
FIG. 11 is a timing chart for the column liquid crystal driver 18.
Figure 12:
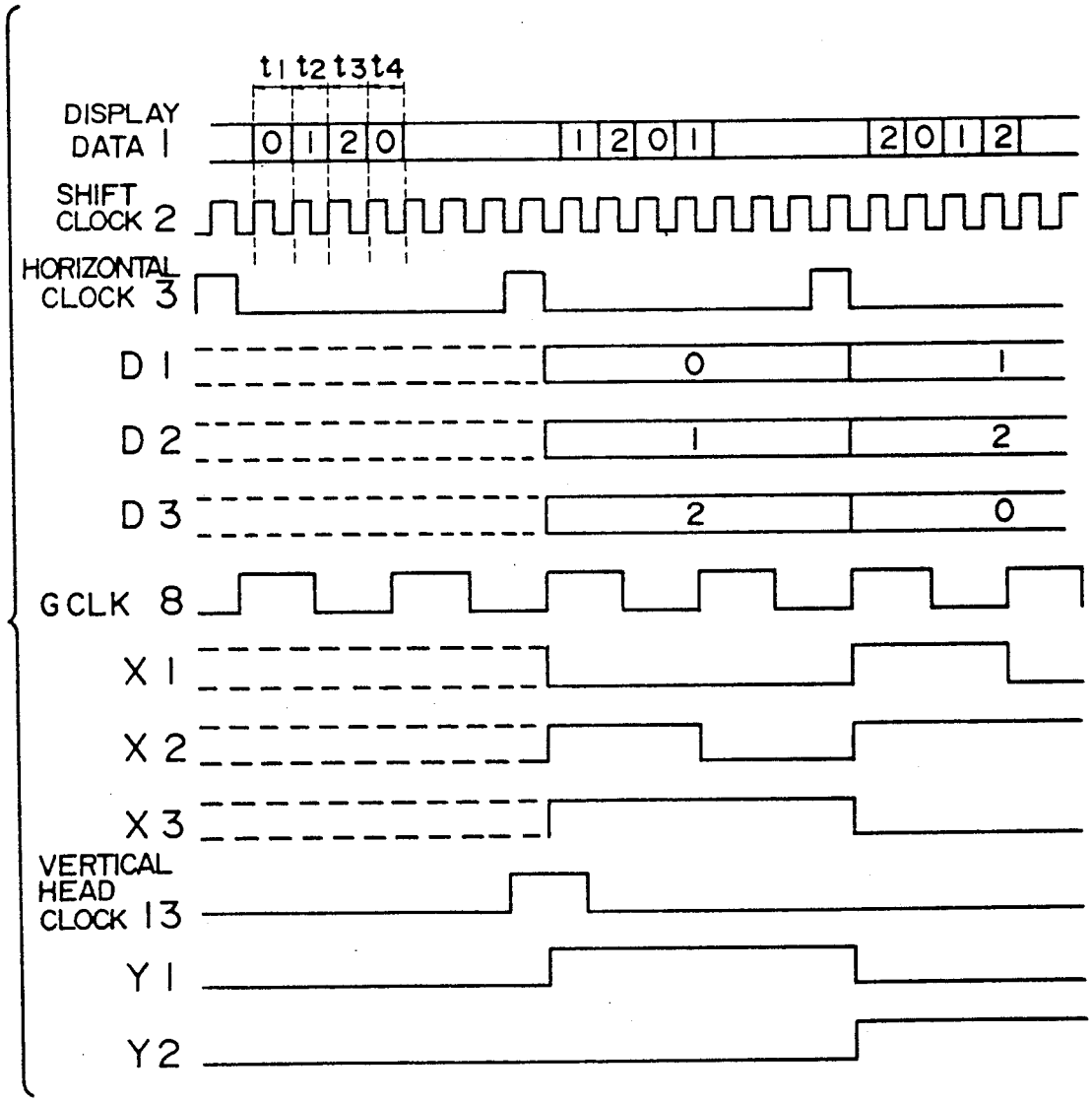
FIG. 12 is a timing chart for the circuit of FIG. 2.
Figure 13:
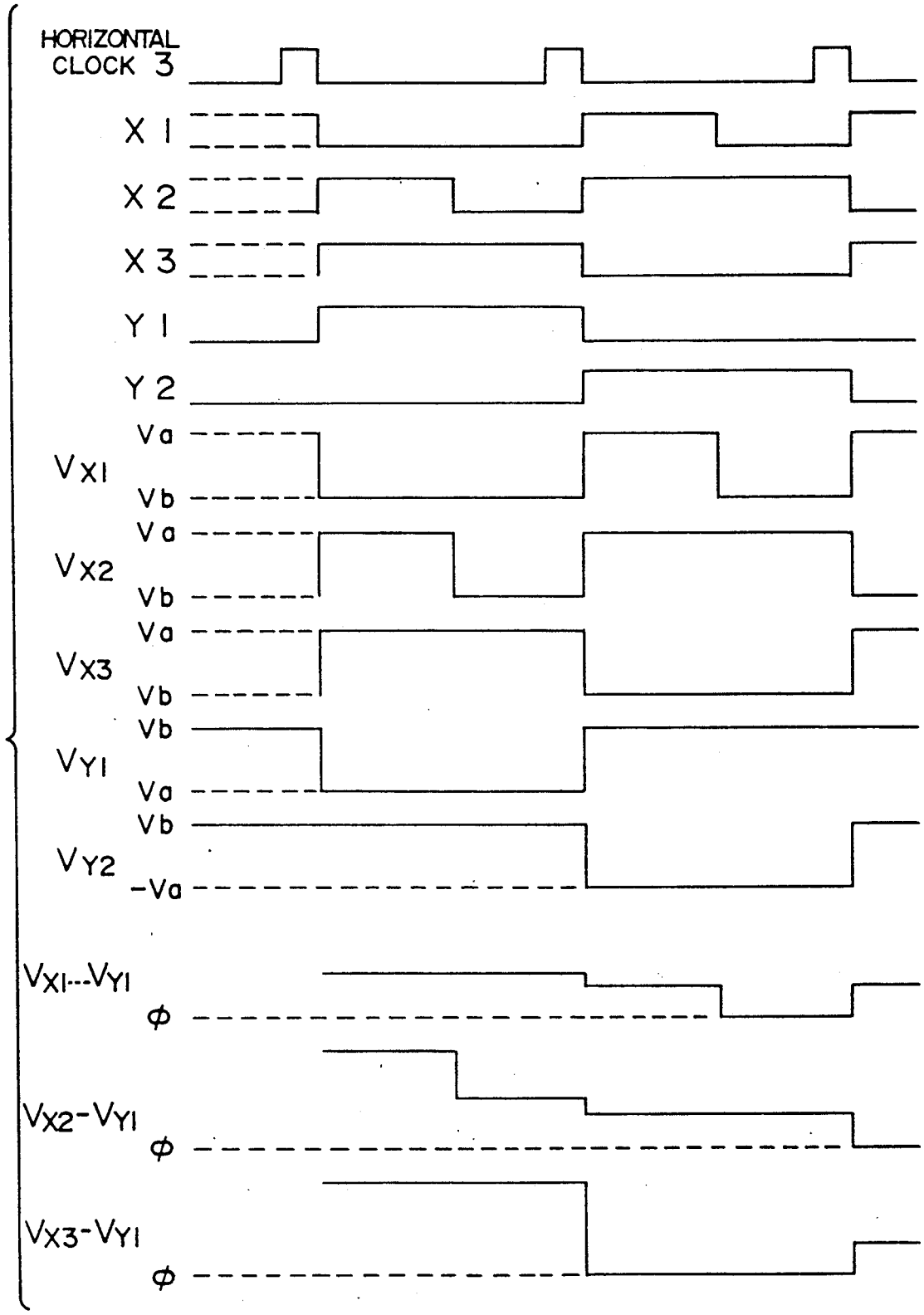
FIG. 13 shows waveforms appearing in the FIG. 2 circuit, including voltage waveforms applied to a liquid crystal panel 22.
Figure 14:
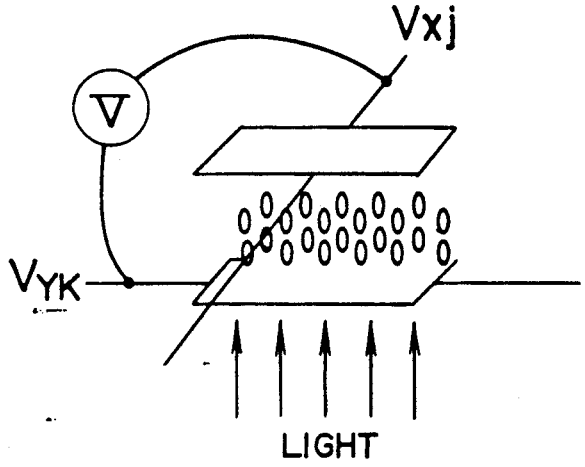
FIG. 14 is a diagrammatic representation useful to explain the principle of operation of the liquid crystal panel 22.
Figure 15:
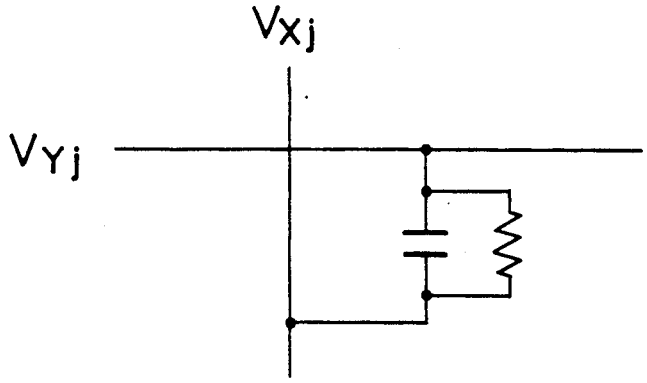
FIG. 15 is an electrical equivalent circuit of the FIG. 14 liquid crystal panel.
Figure 16:
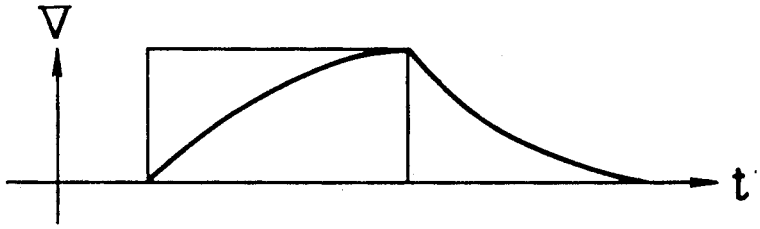
FIG. 16 shows a normal charging waveform of the liquid crystal panel 22.
Figure 17:
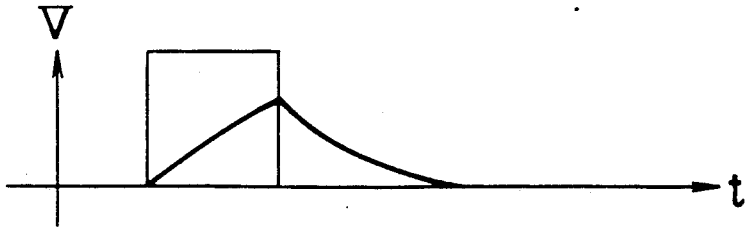
FIG. 17 shows a charging waveform appearing when the liquid crystal pannel 22 is driven to display half tone.
Figure 18:
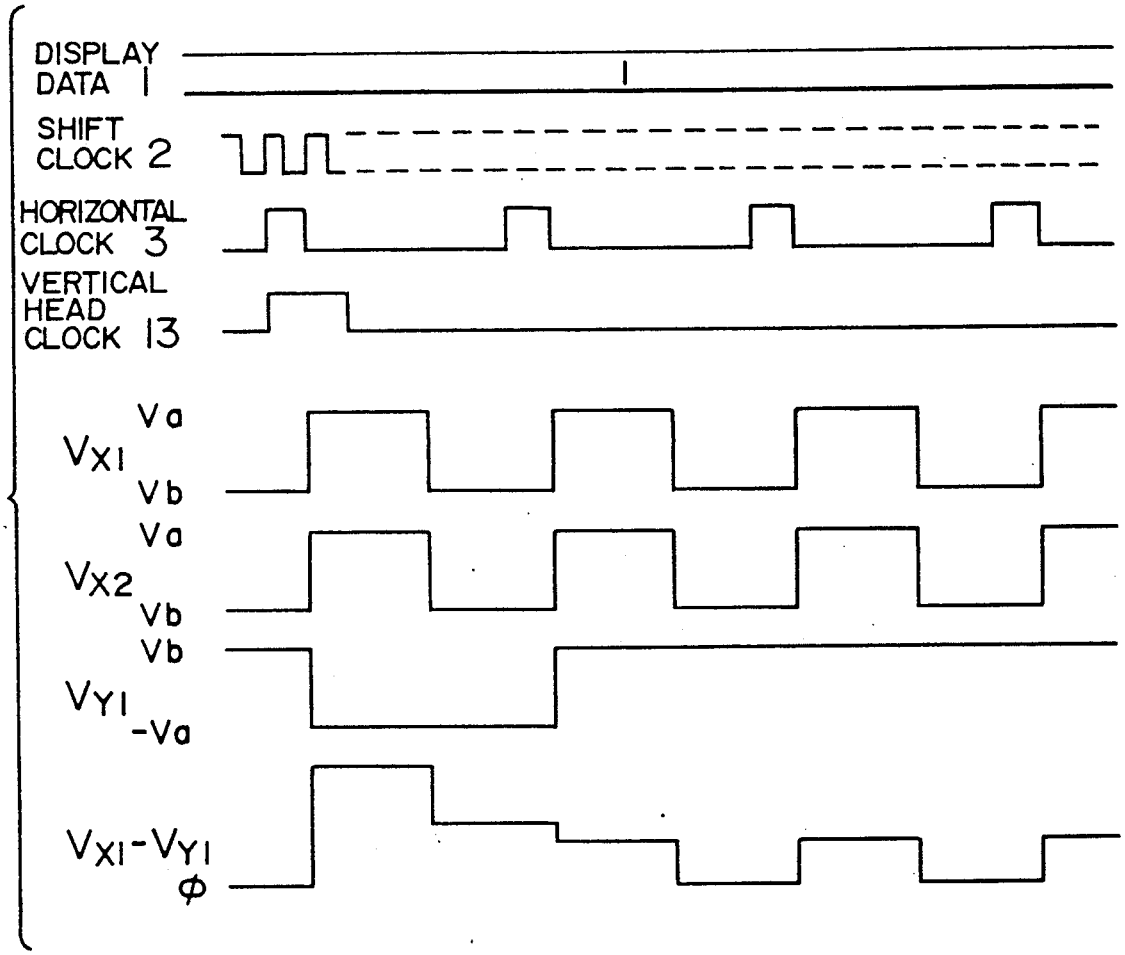
FIG. 18 shows ideal waveforms appearing when the half tone display is effected over a wide area of the liquid crystal panel 22.
Figure 19:
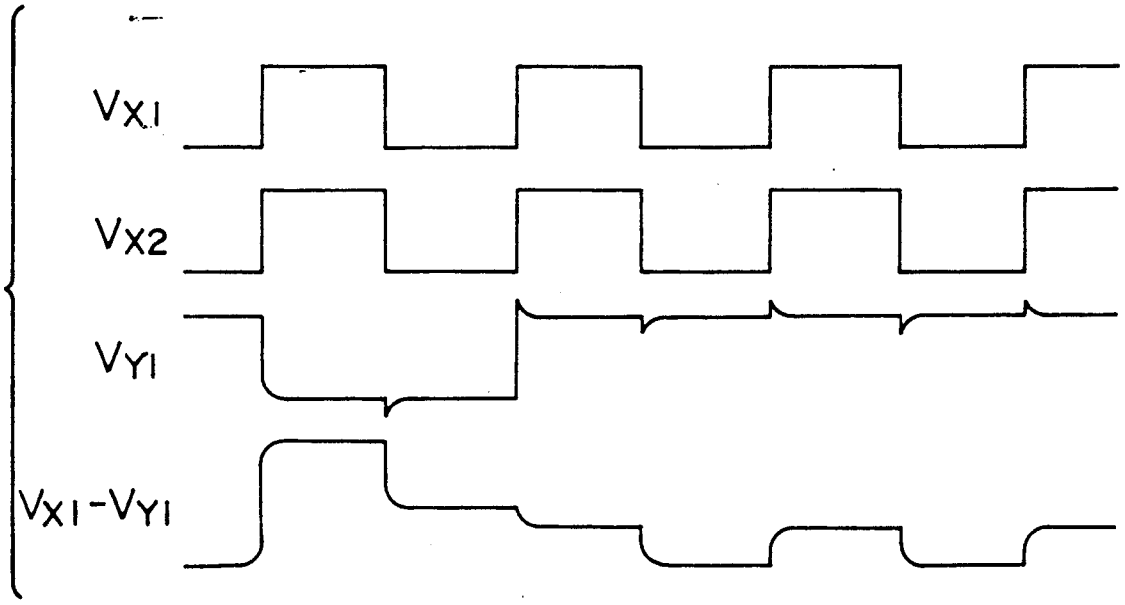
FIG. 19 shows actual forms of the FIG. 18 waveforms.
Figure 20:
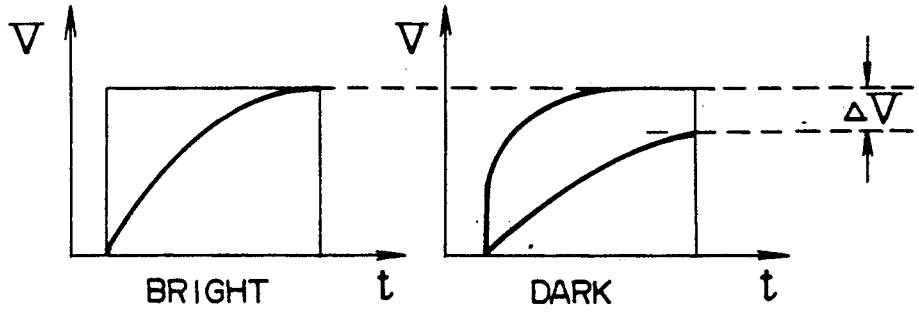
FIG. 20 shows charging waveforms in the waveforms of FIGS. 18 and 19.

Reference numerals 1 to 10 and 12 to 22 designate the same components or elements as those of FIG. 2 which are referred to in describing Background of the Invention.

Denoted by 101 is a 1/n pulse signal processor for pulse signal processing of a 1/n duration pulse (simply referred to as 1/n pulse) 10 for half tone display.

In a half tone display driving circuit for a liquid crystal matrix panel according to the invention, a selector 11 is responsive to select signals 7 to select a signal, which is necessary for the liquid crystal matrix panel to operate for display, from "high" signal, "low" signal and pulse signal 102 resulting from signal processing at the 1/n pulse signal processor 101, and the selected signal is applied to the column liquid crystal driver 18 so that a decrease in brightness of display can be prevented when the half tone display is effected.

Signal processing effective to prevent the decrease in brightness may be realized in two principal ways as has been described in Summary of the Invention.

In the first way, the 1/n pulse signal processor is constructed of a phase modulator. Through the phase modulator, there are produced n 1/n pulses which are subjected to phase modulation ranging from zero degree to $$\frac{n-1}{n}$$

$\times 360$ degrees and the selector 11 applied the n 1/n pulses to the column liquid crystal driver 18 in such a manner that rise and fall of pulses for adjacent columns occur at the same timing, thereby suppressing noises and preventing brightness of display from decreasing when the liquid crystal matrix panel is driven to display half tone. An embodiment for $n=2$ will be described later with reference to FIG. 1 and an embodiment for $n=3$ with reference to FIG. 26.

In the second way, the 1/n pulse signal processor is constructed of a phase modulator and a channel. A tone pulse is formed on the basis of the 1/n pulse and phase-modulated 1/n pulses and the tone pulse in which the number of voltage edges is decreased is applied to the column liquid crystal driver 18, thereby preventing brightness of display from decreasing when the liquid crystal matrix panel is driven to display half tone. An embodiment for $n=2$ will be described later with reference to FIG. 33 and an embodiment for $n=3$ with reference to FIG. 37.

The first and second ways may be used in combination, wherein an embodiment for $n=2$ will be described later with reference to FIG. 41.

Referring now to FIG. 1 and FIGS. 21 to 25, an embodiment of the invention will be described.

Figure 1:
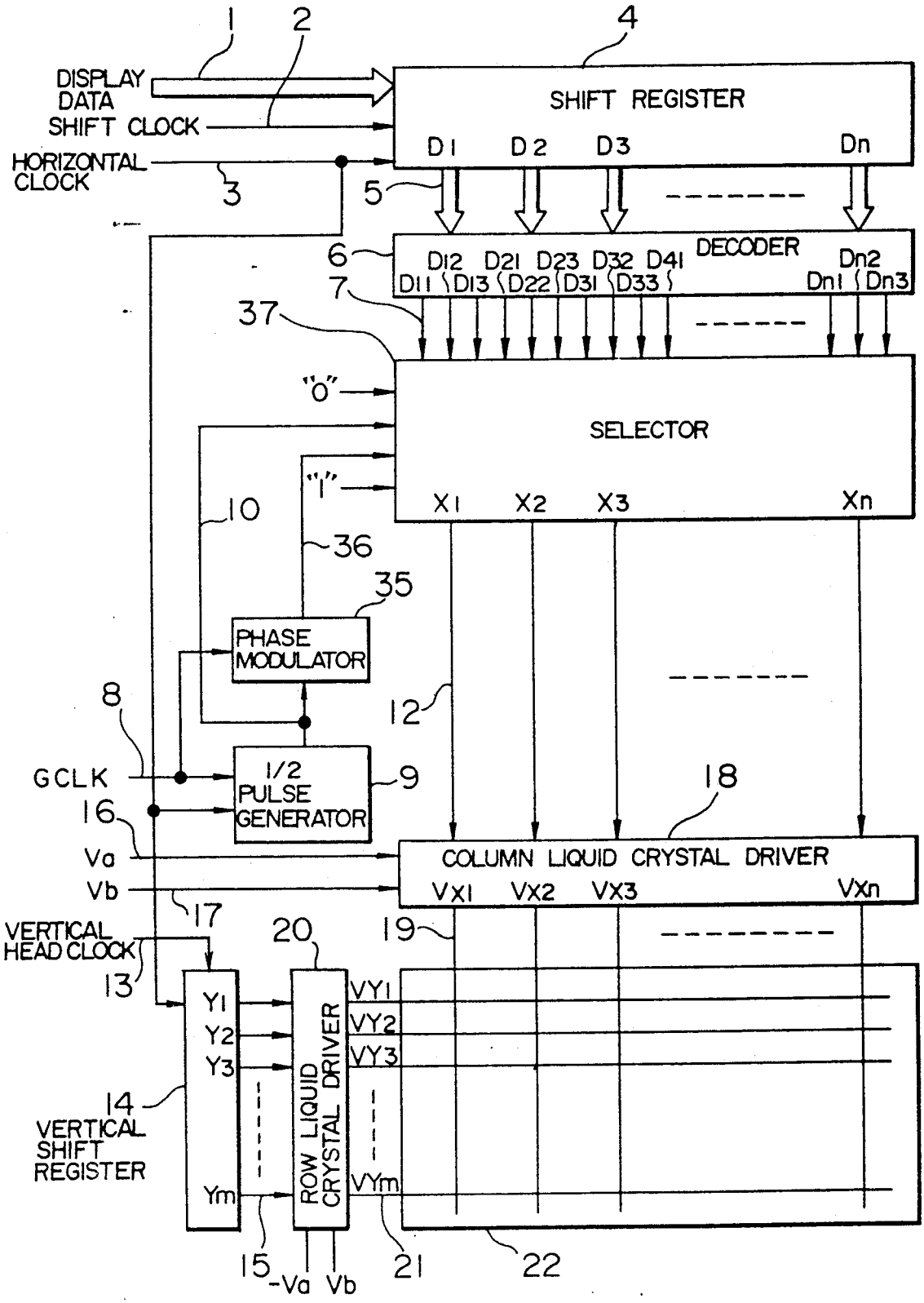
FIG. 1 is a block diagram illustrating an embodiment of a half tone display driving circuit for a liquid crystal matrix panel according to the invention.

In FIG. 1, there is illustrated an embodiment of a half tone display driving circuit for a liquid crystal matrix panel according to the invention.

Reference numerals 1 to 10 and 12 to 22 designate the same components or elements as those of FIG. 2 which are referred to in describing Background of the Invention.

Reference numeral 35 designates a phase modulator for modulating the phase of a ½ duration pulse (hereinafter simply referred to as ½ pulse) 10, and 36 a pulse called ½' pulse herein which results from the phase modulation of the ½ pulse 10 by means of the phase modulator 35.

Denoted by 37 is a selector which receives select signals 7 and selects "high" signal, ½ pulse 10, ½' pulse 36 or "low" signal which is delivered as column selection signal 12.

Figure 21:
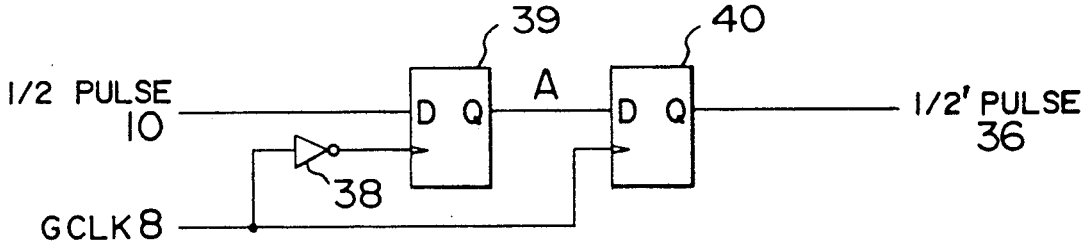
FIG. 21 is a circuit diagram of a phase modulator 35.

FIG. 21 shows an internal circuit of phase modulator 35 including a NOT circuit 38, a first stage D flip-flop 39 and a second stage D flip-flop 40.

Figure 22:
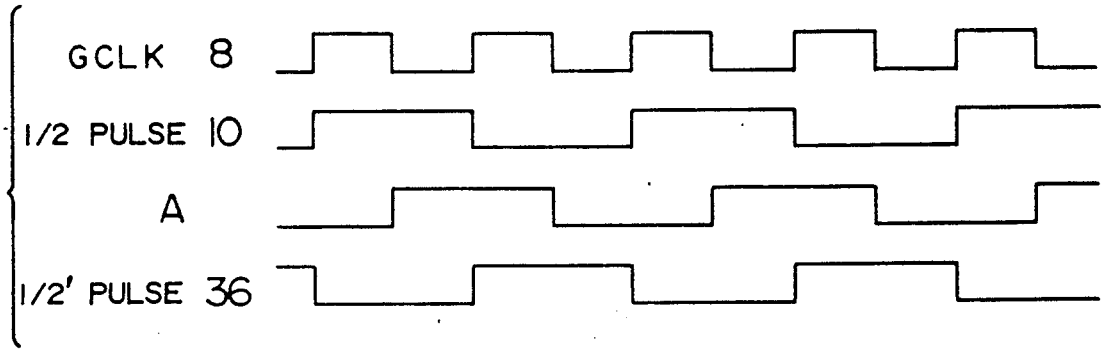
FIG. 22 is a timing chart for the phase modulator 35.

FIG. 22 shows a timing chart for the phase modulator 35.

Figure 23:
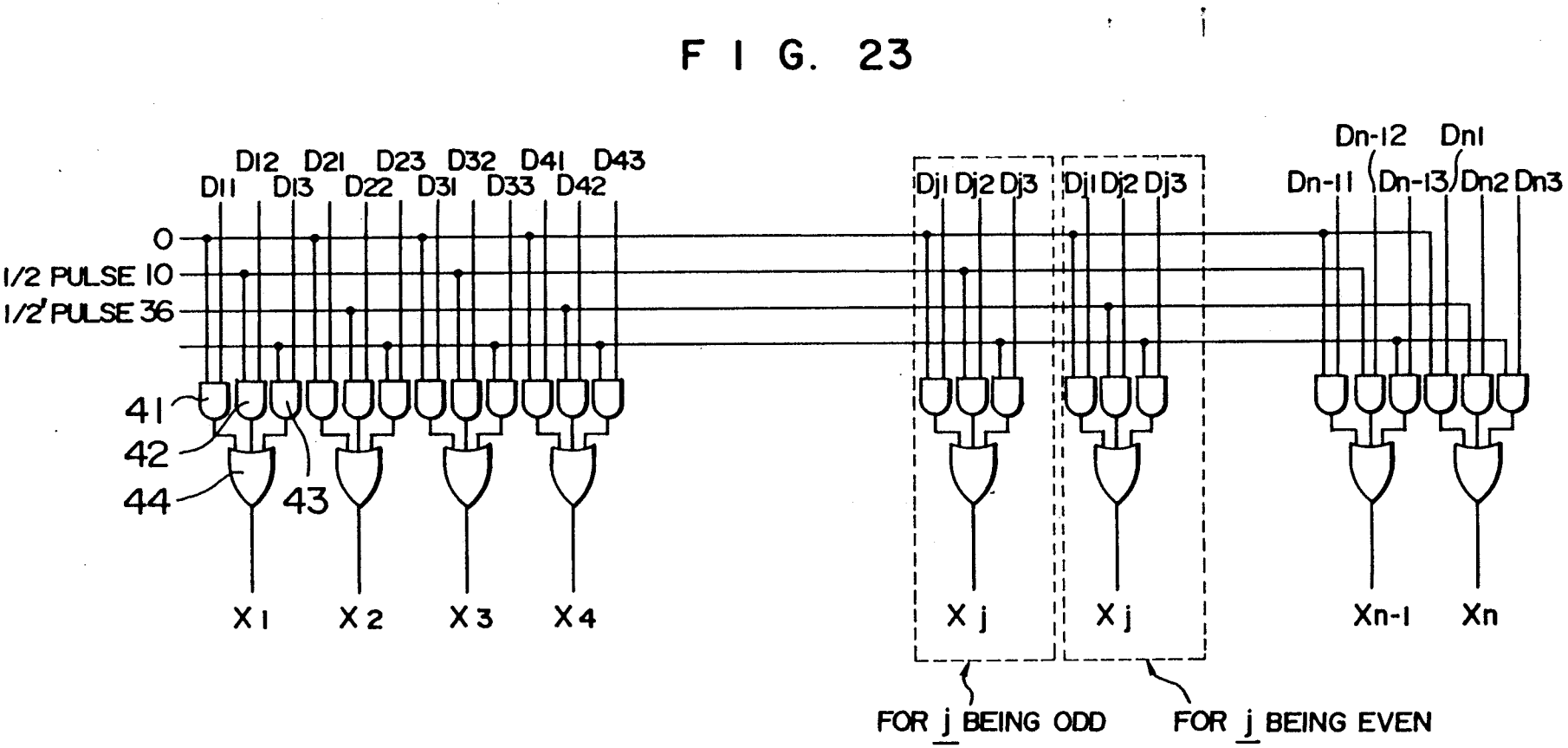
FIG. 23 is a circuit diagram of a selector 37.

FIG. 23 shows an internal circuit of selector 37 including n stages each having AND circuits 41 to 43 and an OR circuit 44.

Figure 24:
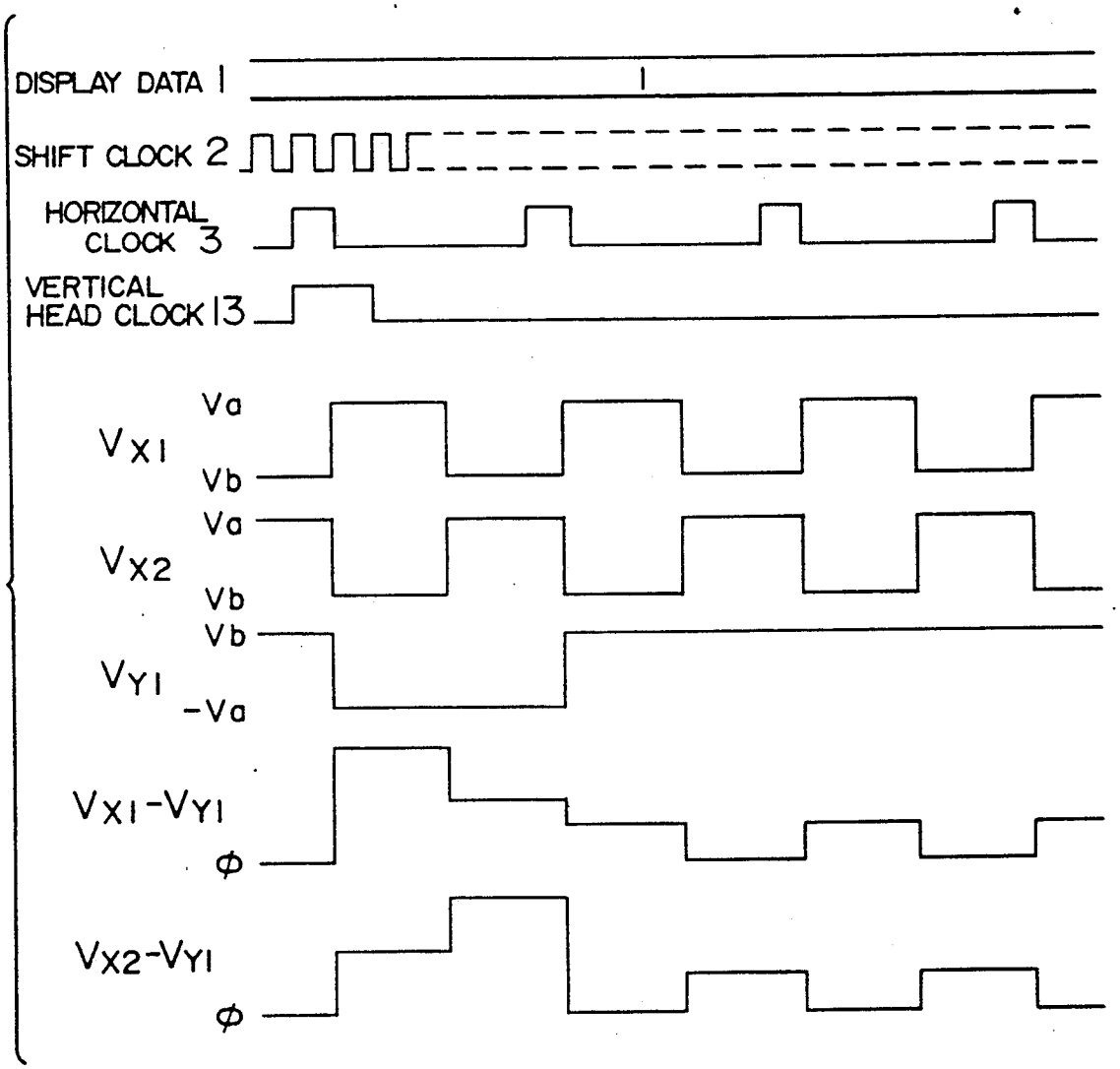
FIG. 24 is a timing chart for the FIG. 1 driving circuit.
Figure 25:
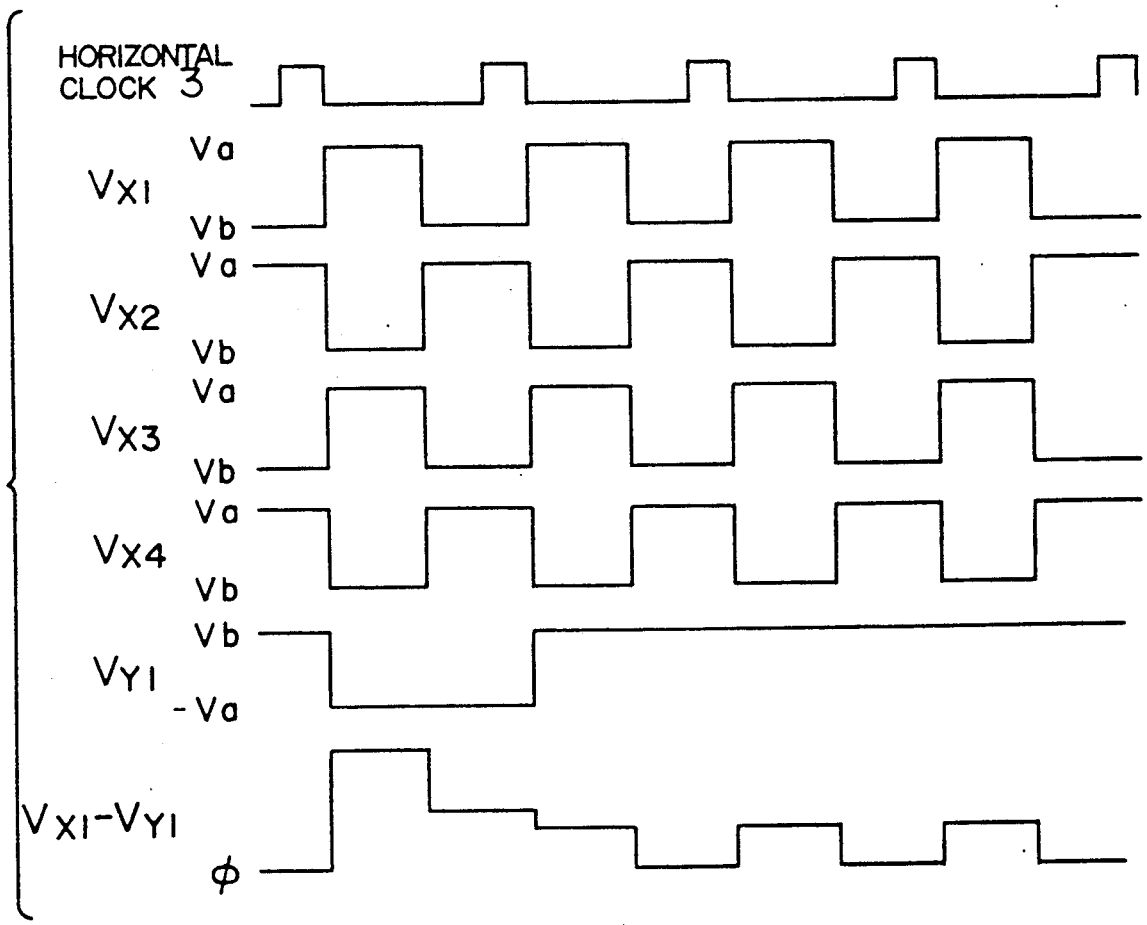
FIG. 25 shows voltage waveforms including a waveform applied to the liquid crystal panel 22 when the FIG. 1 driving circuit operates in accordance with the FIG. 24 timing chart.

FIG. 24 shows a timing chart for the FIG. 1 driving circuit and FIG. 25 voltage waveforms, particularly, applied to the liquid crystal panel 22 when the FIG. 1 driving circuit operates in accordance with the timing chart of FIG. 24.

The operation of the half tone display driving circuit for a liquid crystal matrix panel shown in FIG. 1 will be described with reference to FIG. 24.

Data pieces "1" of display data 1 are sequentially inputted, fetched by the display data shift register 4 and delivered as horizontal display data 5 during the succeeding horizontal period. In the phase modulator 35 having the circuit construction of FIG. 21, GCLK 8 and ½ pulse 10 are received, the D flip-flop 39 generates a signal A which is 90° out of phase relative to the ½ pulse and the D flip-flop 40 generates a ½' pulse which is 180° out of phase relative to the ½ pulse, as shown in FIG. 22.

The selector 37 constructed as shown in FIG. 23 includes n stages each having the AND circuits 41 to 43 and the OR circuit 44. The selector 37 produces a "high" signal as column selection signal 12 at the output of the OR circuit 44 when the AND circuit 41 receives "1" of selection signal 7, a ½ pulse 10 in the case of the stage of interest being an odd stage but a ½' pulse 36 in the case of the stage being an even stage when the AND circuit 42 receives "1" of selection signal 7, and a "low" signal when the AND circuit 43 receives "1" of selection signal 7.

Thus, in the selector 37 receiving the selection signals 7, odd stages deliver the ½ pulses as signals X1, X3, X5, - - - Xn−1 of column selection signal and even stages deliver the ½' pulses 36 as signals X2, X4, X6, - - - Xn of column selection signal.

In this manner, the column liquid crystal driver 18 delivers signals $V_{X1}$, $V_{X3}$, $V_{X5}$, - - - $V_{Xn-1}$ of column driving signal 19 for odd columns each assuming "Va" during the first half of one horizontal period and "Vb" during the second half thereof, and signals $V_{X2}$, $V_{X4}$, $V_{X6}$, - - - $V_{Xn}$ for even columns each assuming "Vb" during the first half of one horizontal period and "Va" during the second period thereof.

On the other hand, the vertical shift register 14 first receives the line head clock 13 and thereafter shifts to sequentially produce −Va as one of signals $V_{Y1}$ to $V_{Ym}$ of the row driving signal 21 in synchronism with fall edges of the horizontal clock signals 3 while producing Vb as the remaining signals of the row driving signal 21.

FIG. 25 shows voltage waveforms, particularly, applied to the liquid crystal panel 22 when the driving circuit operates in accordance with the timing chart of FIG. 24.

As will be seen from FIG. 25, voltages at adjacent columns change to produce rise edge and fall edge at the same timing, respectively, and therefore noises induced in row driving signals through the liquid crystal can be cancelled to eliminate or suppress a decrease in brightness of display.

In the foregoing, the half tone display driving circuit for a liquid crystal matrix panel is described by referring to $\frac{1}{2}$ pulse width modulation as an example but it may be realized for 1/n pulse width modulation in a similar manner. Another embodiment for $\frac{1}{3}$ pulse width modulation will be described with reference to FIGS. 26 to 32.

Figure 26:
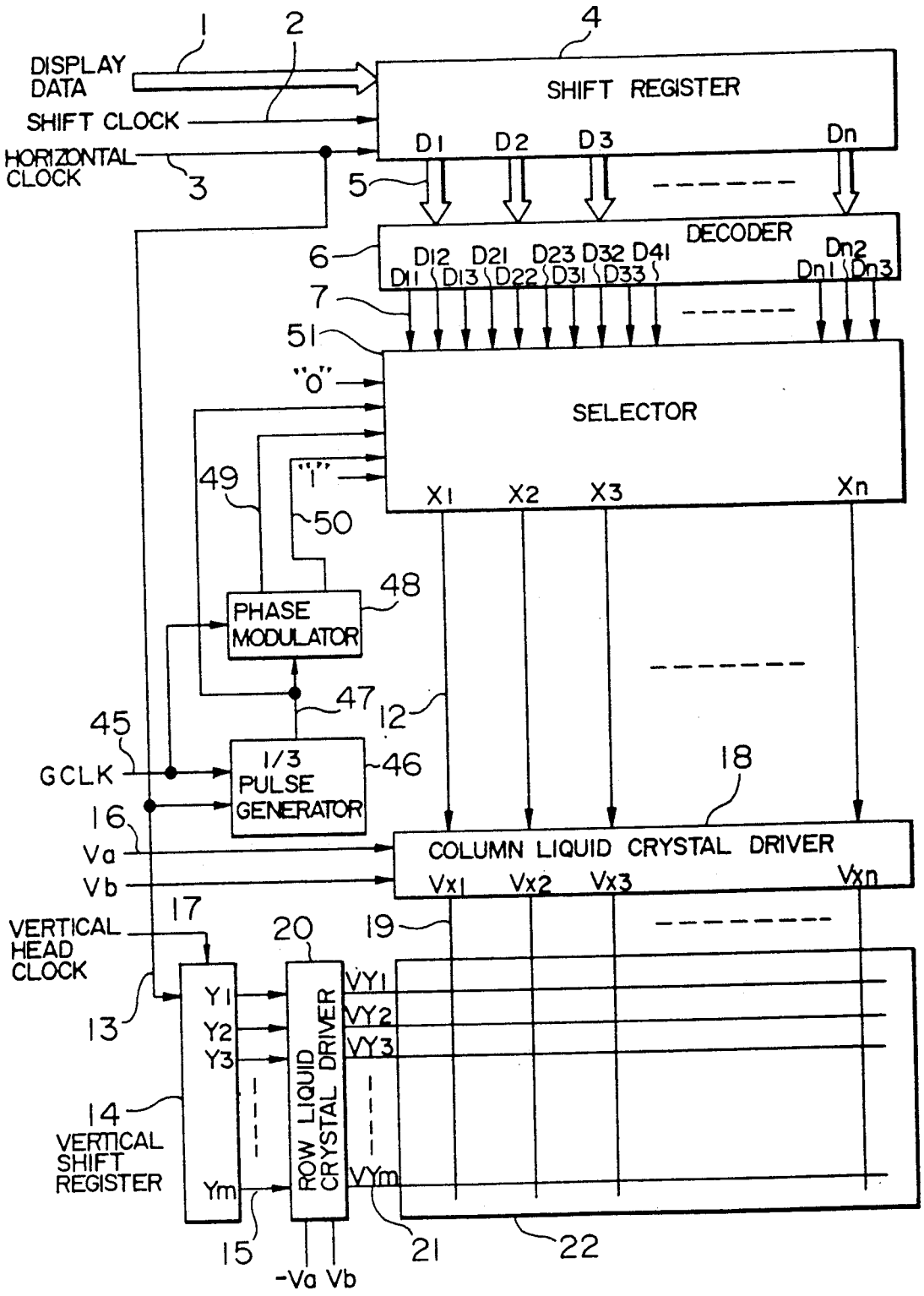
FIG. 26 is a block diagram illustrating another embodiment of a half tone display driving circuit for a liquid crystal matrix panel according to the invention.

FIG. 26 is a block diagram illustrating another embodiment of the half tone display driving circuit for a liquid crystal matrix panel according to the invention.

Reference numerals 1 to 7 and 12 to 22 designate the same components or elements as those of FIG. 2.

Reference numeral 45 designates a clock GCLK having three cycles during one horizontal period, 46 a $\frac{1}{3}$ pulse generator for generating a pulse which assumes "high" during the first $\frac{1}{3}$ part of one horizontal period and "low" during the remaining part, and 47 a $\frac{1}{3}$ duration pulse (hereinafter simply referred to as $\frac{1}{3}$ pulse) produced from the $\frac{1}{3}$ pulse generator, having duration equal to $\frac{1}{3}$ of one horizontal period. Reference numeral 48 designates a phase modulator for modulating the phase of the $\frac{1}{3}$ pulse, and 49 a $\frac{1}{3}'$ pulse resulting from the phase modulation of the $\frac{1}{3}$ pulse 47 by means of the phase modulator and assuming "high" during the second $\frac{1}{3}$ part of one horizontal period. Denoted by 50 is a $\frac{1}{3}''$ pulse similar to the $\frac{1}{3}'$ pulse 49 but assuming "high" during the third $\frac{1}{3}$ part of one horizontal period.

Reference numeral 51 designates a selector which responds to select signals 7 to selectively deliver "high" signal, $\frac{1}{3}$ pulse 47, $\frac{1}{3}'$ pulse 49, $\frac{1}{3}''$ pulse 50 or "low" signal as column selection signal 12.

Figure 27:
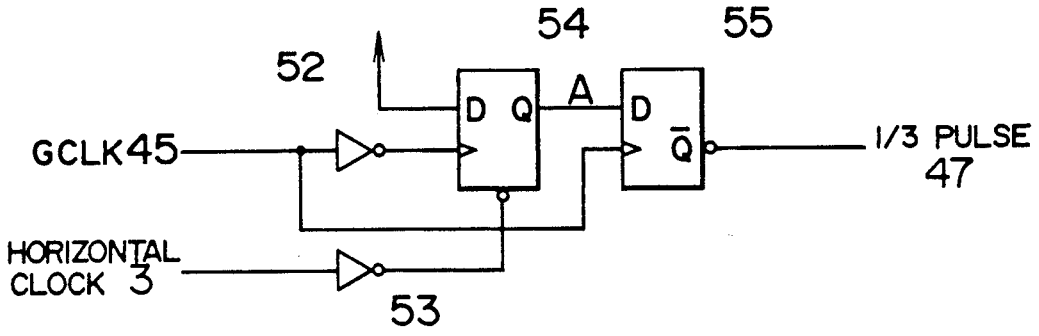
FIG. 27 is a circuit diagram of a ⅓ pulse generator 46.

FIG. 27 shows an internal circuit of $\frac{1}{3}$ pulse generator 46 including NOT circuits 52 and 53 and D flip-flops 54 and 55.

Figure 28:
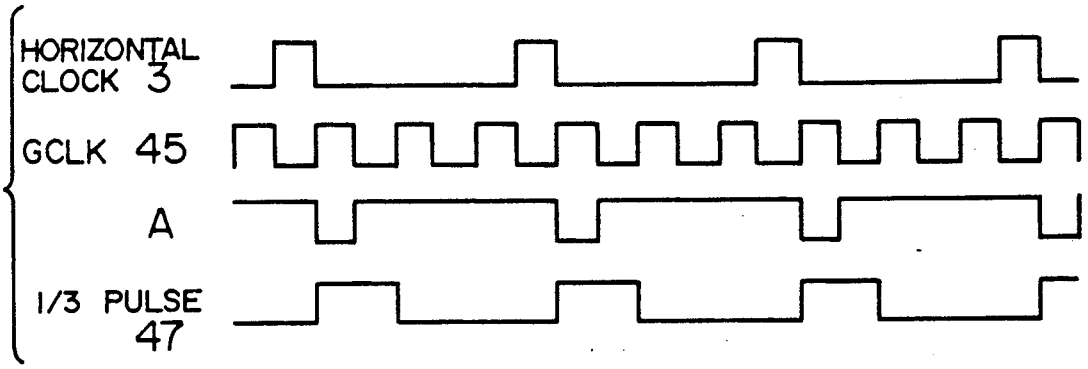
FIG. 28 is an operational timing chart for the ⅓ pulse generator 46.

FIG. 28 shows an operational timing chart for the $\frac{1}{3}$ pulse generator 46.

Figure 29:
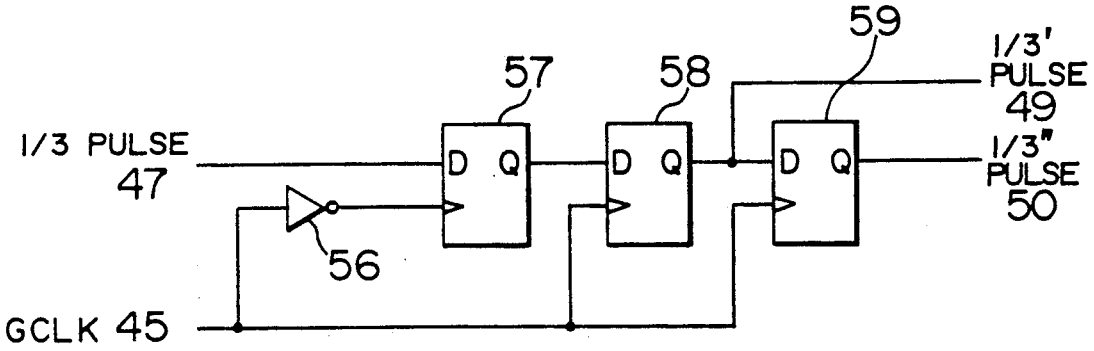
FIG. 29 is a circuit diagram of a phase modulator 48.

FIG. 29 shows an internal circuit of phase modulator 48 including a NOT circuit 56 and D flip-flops 57 to 59.

Figure 30:
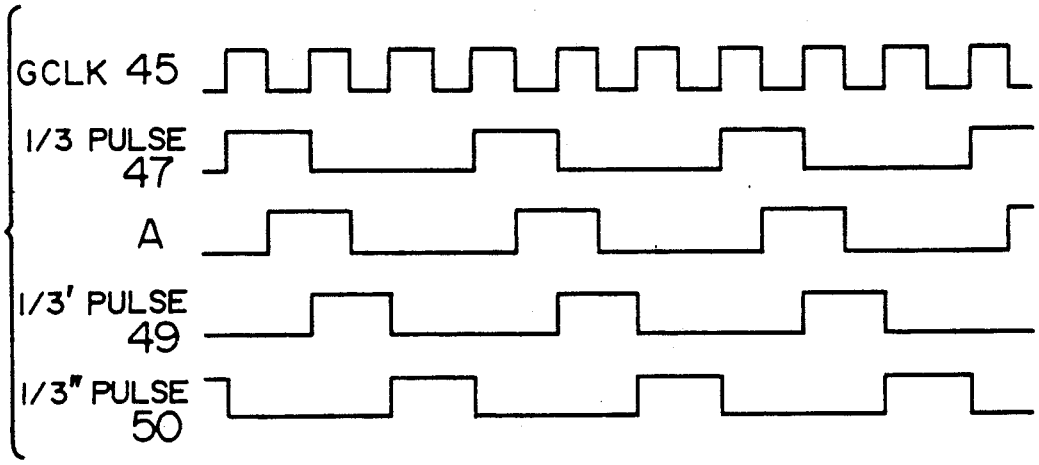
FIG. 30 is a timing chart for the phase modulator 48.

FIG. 30 is a timing chart for the phase modulator 48.

Figure 31:
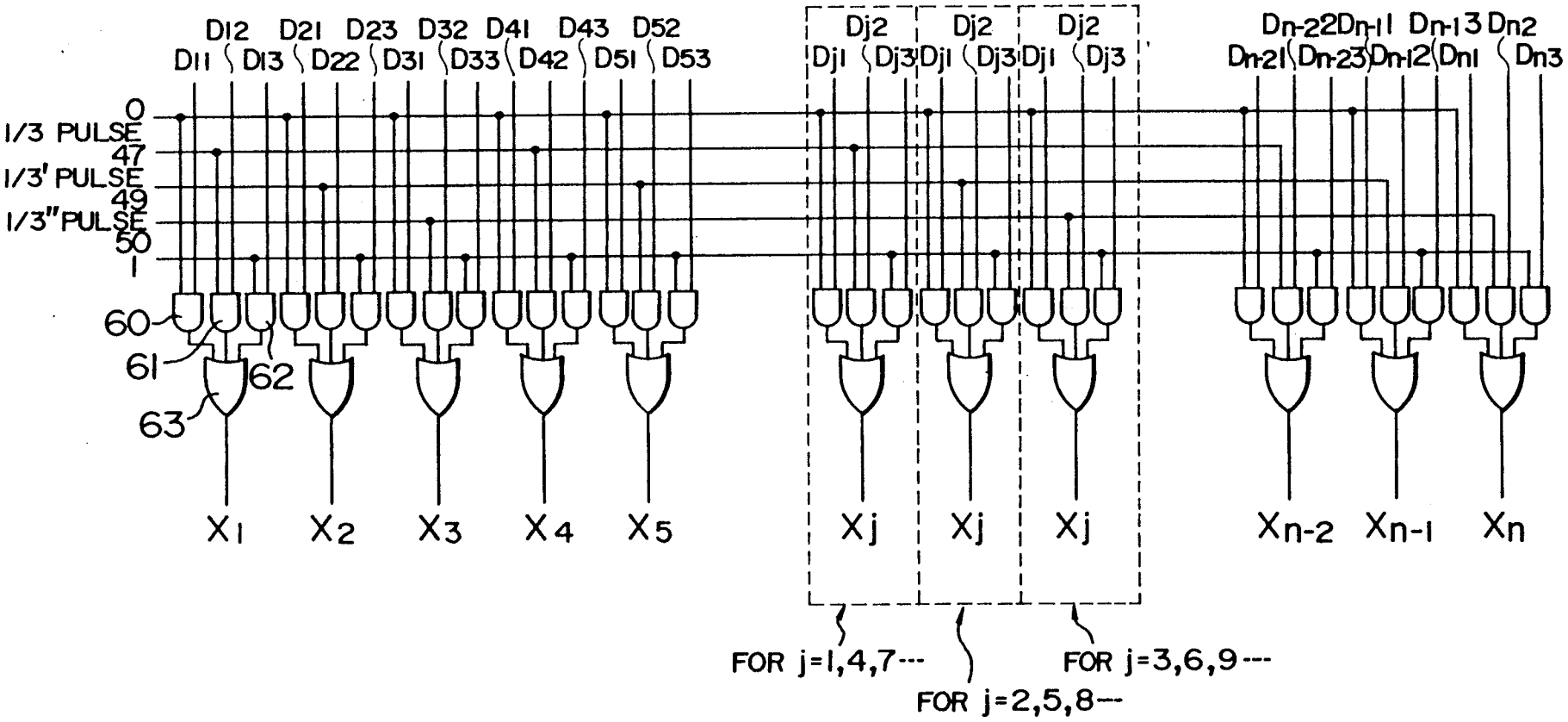
FIG. 31 is a circuit diagram of a selector 51.

FIG. 31 shows an internal circuit of selector 51 including n stages each having AND circuits 60 to 62 and an OR circuit 63.

Figure 32:
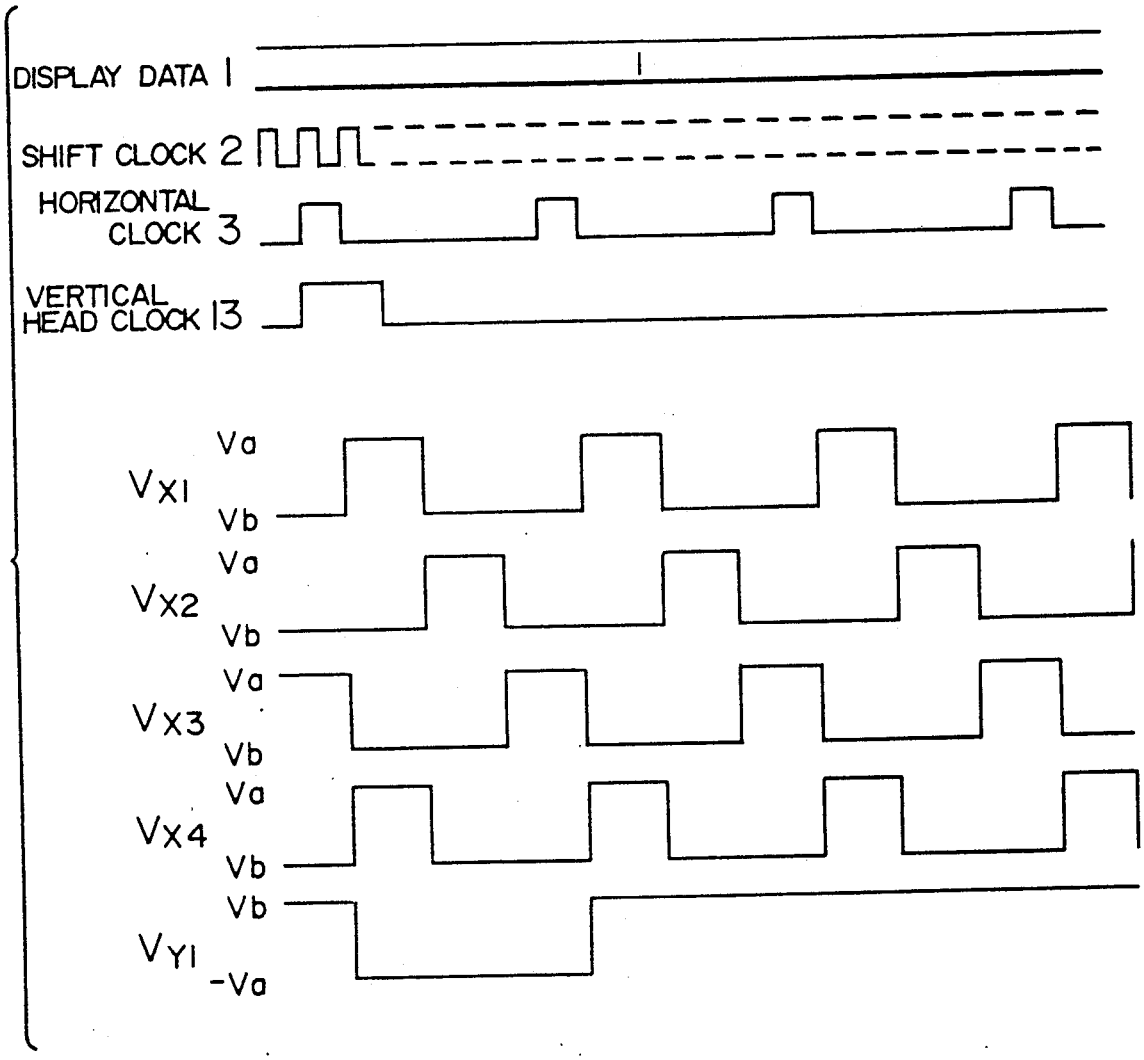
FIG. 32 is a timing chart for the FIG. 26 driving circuit.

FIG. 32 shows a timing chart of the operation of the FIG. 26 driving circuit.

The operation of the FIG. 26 driving circuit will now be described with reference to FIG. 32.

In connection with display signal 1 to selection signal 7, flow and behavior are similar to FIG. 1. In this embodiment, data pieces "1" of the display data 1 are sequentially inputted and "1" is delivered as signals $D_{12}$, $D_{22}$, - - - $D_{n2}$ of the select signal 7 while "0" is delivered as the remaining signals of the select signal 7.

The $\frac{1}{3}$ pulse generator 46 constructed as shown in FIG. 27 has the NOT circuits 52 and 53 and the D flip-flops 54 and 55 and it responds to the GCLK 45 and horizontal clock 3 to produce a $\frac{1}{3}$ pulse 47.

The phase modulator 48 constructed as shown in FIG. 29 has the NOT circuit 56 and the D flip-flops 57 to 59 and in the phase modulator 48, the D flip-flop 57 generates a signal which is 60° out of phase relative to the $\frac{1}{3}$ pulse 47, the D flip-flop 58 generates a $\frac{1}{3}'$ pulse 49 which is 120° out of phase relative to the $\frac{1}{3}$ pulse 47 and the D flip-flop 59 generates a $\frac{1}{3}''$ pulse 50 which is 240° out of phase relative to the $\frac{1}{3}$ pulse 47, as shown in FIG. 30.

The selector 51 constructed as shown in FIG. 31 includes n stages each having the AND circuits 60 to 62 and the OR circuit 63. The selector 51 produces a "high" signal as column selection signal 12 at the output of the OR circuit 61 when the AND circuit 60 receives "1" of select signal 7, a $\frac{1}{3}$ pulse 47 in the case of the stage of interest being 1, 4, 7, - - - , a $\frac{1}{3}'$ pulse 49 in the case of the stage being 2, 5, 8, - - - or a $\frac{1}{3}''$ pulse 50 in the case of the stage being 3, 6, 9, - - - when the AND circuit 61 receives "1" of select signal 7, and a "low" signal when the AND circuit 62 receives "1" of select signal 7.

Thus, the selector 51 receiving the select signals 7 delivers $\frac{1}{3}$ pulses 47 as signals X1, X4, X7 - - - of column selection signal 12, $\frac{1}{3}'$ pulses 49 as signals X2, X5, X8 - - - of column selection signal and $\frac{1}{3}''$ pulses 50 as signals X3, X6, X9 - - - of column selection signal.

In this manner, the column liquid crystal driver 18 delivers signals $V_{X1}$, $V_{X4}$, $V_{X7}$, - - - of column driving signal 19 each assuming Va during the first $\frac{1}{3}$ part of one horizontal period and Vb during the remaining part thereof, signals $V_{X2}$, $V_{X5}$, $V_{X8}$ - - -each assuming Va during the second $\frac{1}{3}$ part of one horizontal period and Vb during the remaining part thereof, and signals $V_{X3}$, $V_{X6}$, $V_{X9}$ - - - each assuming Va during the third $\frac{1}{3}$ part of one horizontal period and Vb during the remaining part thereof.

On the other hand, the row driving signals behave as in the case of the FIG. 1 driving circuit.

In this manner, voltages of adjacent column driving signals 19 change to produce rise edge and fall edge at the same timing, respectively, and therefore noises induced in row driving leads can be cancelled to eliminate or suppress a decrease in brightness of display. The effect obtained with the $\frac{1}{2}$ pulse can thus be attained with the $\frac{1}{3}$ pulse and more generally, with 1/n pulse.

As described previously the driving circuits of FIGS. 1 and 26 exemplify a method by which voltages of adjacent column driving signals 19 change to produce rise edge and fall edge at the same timing, respectively, whereby noises induced in row driving signals 21 can be cancelled to eliminate or suppress a decrease in brightness of display. This effect can also be attained by changing the phase of pulse on each column driving lead to decrease the frequency of occurrence of voltage change edges. Still another embodiment to this effect will now be described with reference to FIGS. 33 to 36.

Figure 33:
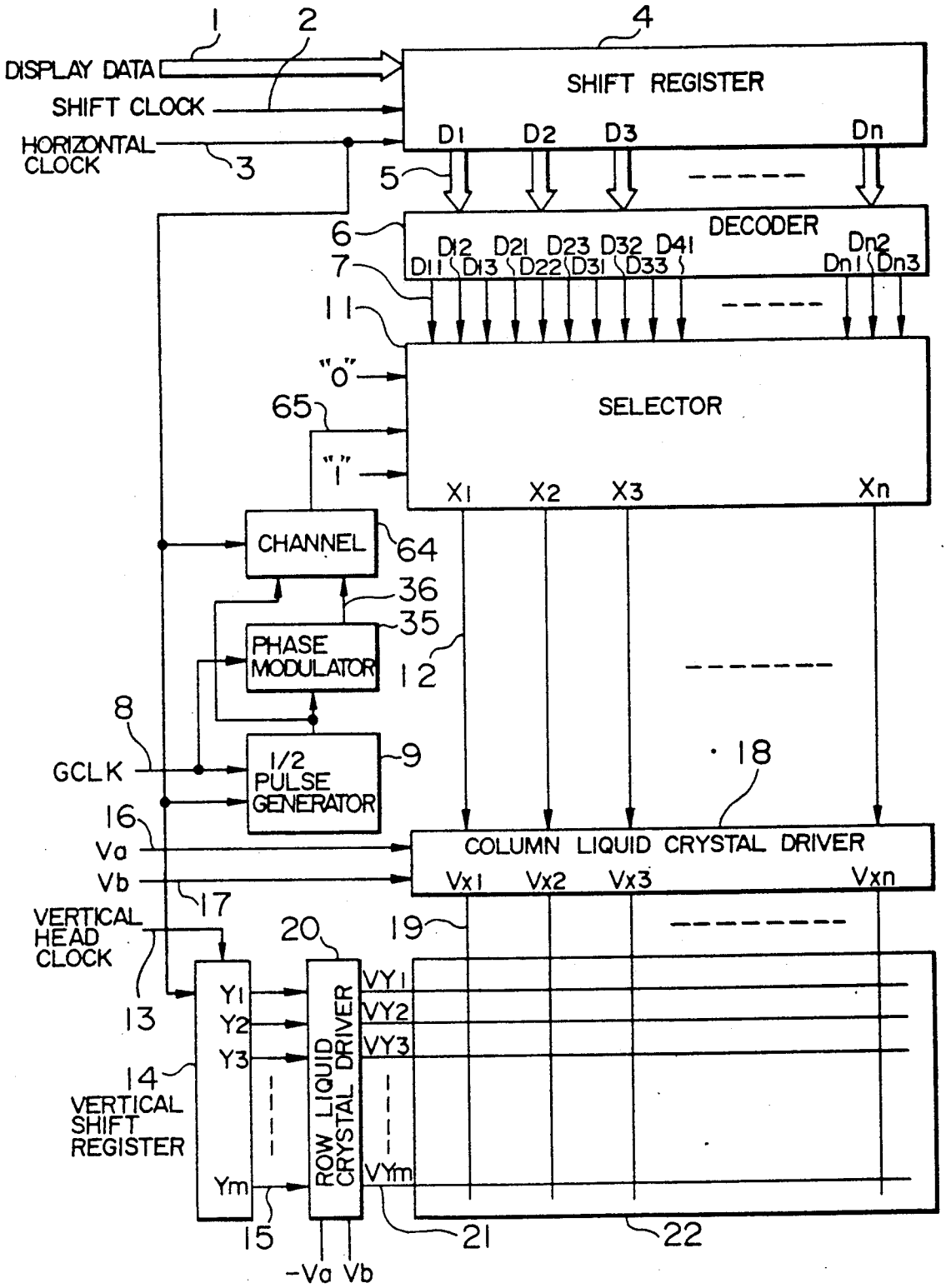
FIG. 33 is a block diagram illustrating still another embodiment of a half tone display driving circuit for a liquid crystal matrix panel according to the invention.

FIG. 33 is a block diagram illustrating still another embodiment of the half tone display driving circuit for a liquid crystal matrix panel according to the invention.

Reference numerals 1 to 22 designate the same components or elements as those of FIG. 2.

Reference numerals 35 and 36 designate the same elements as those of FIG. 1.

Reference numeral 64 designates a channel for switching a $\frac{1}{2}$ pulse 10 and a $\frac{1}{2}'$ pulse 36, and 65 a tone pulse delivered out of the channel 64.

Figure 34:
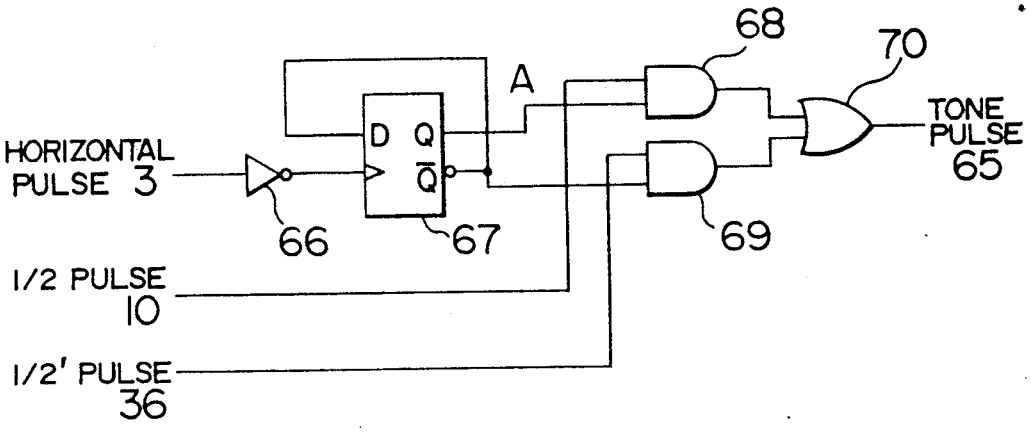
FIG. 34 is a circuit diagram of a channel 64.

FIG. 34 shows an internal circuit of channel 64 including a NOT circuit 66, a D flip-flop 67, AND circuits 68 and 69 and an OR circuit 70.

Figure 35:
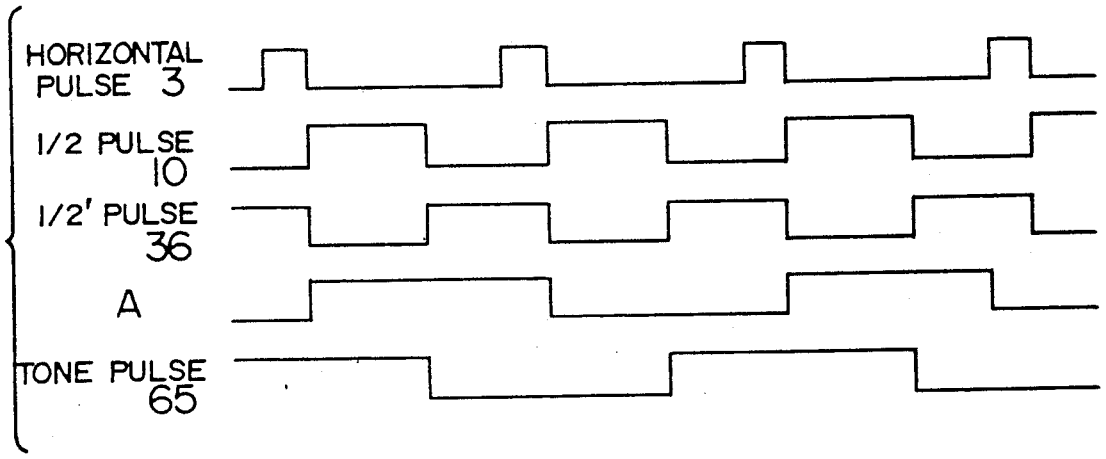
FIG. 35 is a timing chart for the channel 64.
Figure 36:
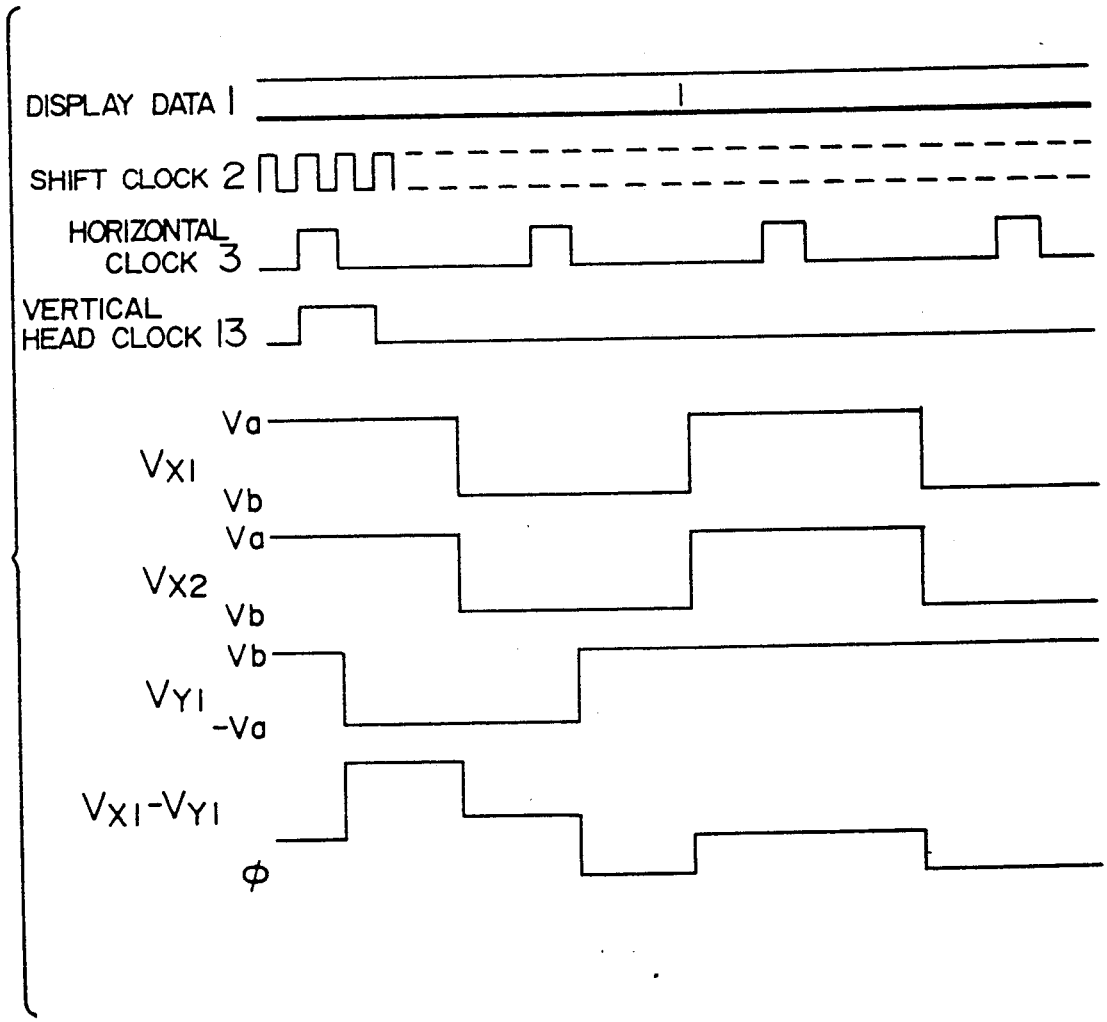
FIG. 36 is a timing chart for the FIG. 33 driving circuit.

FIG. 35 is a timing chart for the channel 64, and FIG. 36 is a timing chart for the FIG. 33 driving circuit.

The operation of the FIG. 33 driving circuit will now be described in accordance with the flow chart of FIG. 36.

As explained in connection with the FIG. 1 driving circuit, data pieces "1" of display data 1 are sequentially inputted and delivered as select signals 7.

A ½ pulse 10 and a ½' pulse 36 are generated and delivered similarly to FIG. 1.

The channel 64 constructed as shown in FIG. 34 responds to the fall of the horizontal clock 3 to produce a tone pulse 65 on the basis of the ½ pulse 10 and ½' pulse 36, as shown in FIG. 35.

Then, the selector 37 receiving the select signals 7 produces, as signals $X_l$ to $X_n$ of column selection signal, a signal which repeats rising at the center of one horizontal period and falling at the center of the succeeding horizontal period.

Thus, the column driving signal 19 has a voltage waveform which repeats assuming Va at the center of one horizontal period and Vb at the center of the succeeding horizontal period.

On the other hand, the row driving signal 21 behaves similarly to that of FIG. 1.

Through the above operation, the frequency of occurrence of voltage change edges of the column driving signals 19 can be decreased and consequently noises induced in row driving signals 19 can be suppressed to prevent a decrease in brightness of display.

The FIG. 33 embodiment is described as using the ½ pulse but more generally a 1/n pulse may be used. An embodiment using a ⅓ pulse will now be described with reference to FIGS. 37 to 40.

Figure 37:
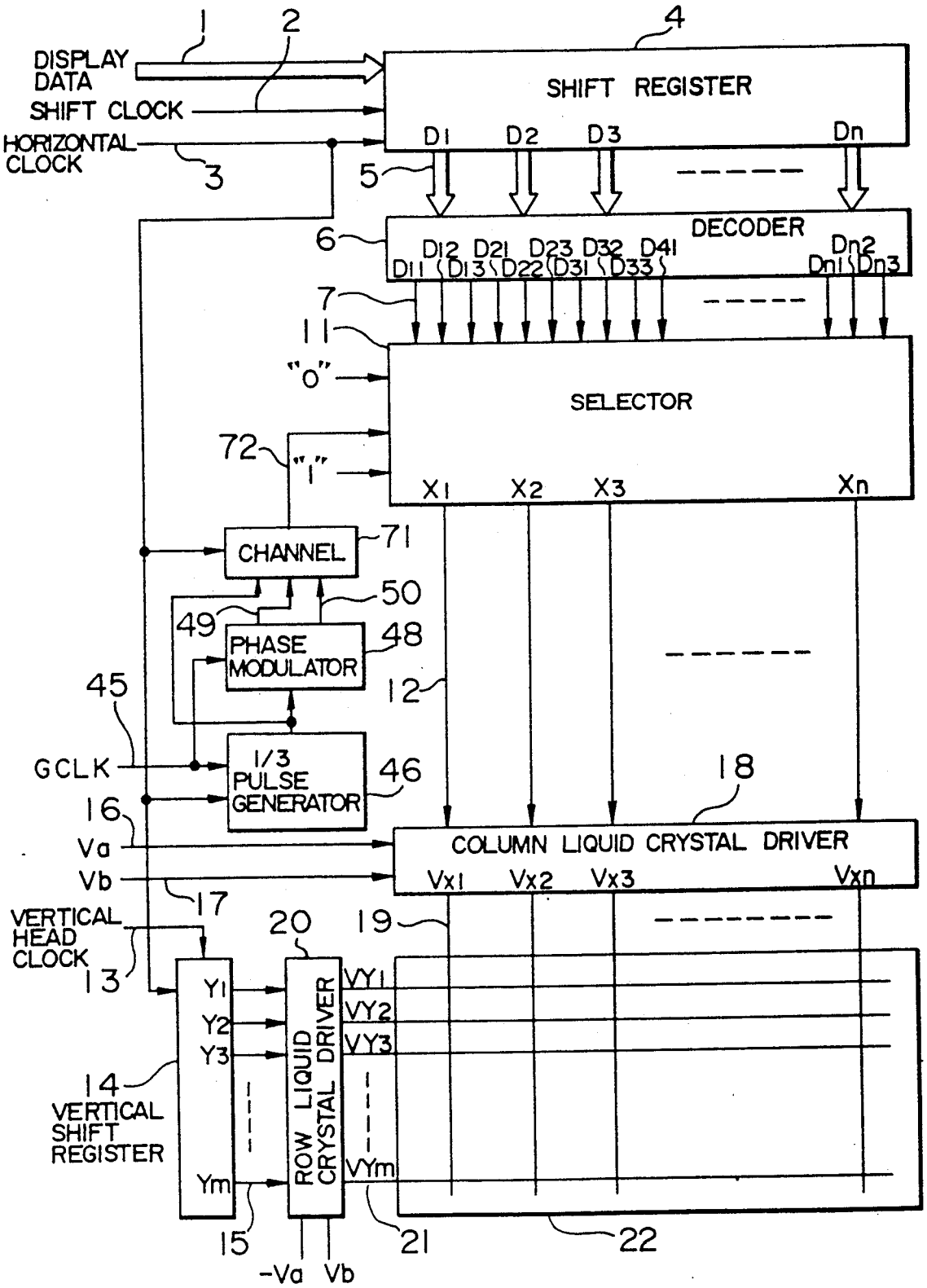
FIG. 37 is a block diagram illustrating still another embodiment of a half tone display driving circuit for a liquid crystal matrix panel according to the invention.

FIG. 37 illustrates still another embodiment of the driving circuit wherein a ⅓ duration pulse is used and the phase of pulse on each column driving lead is changed.

Reference numerals 1 to 7 and 11 to 22 designate the same components as those of FIG. 2.

Reference numerals 45 to 50 designate the same components as those of FIG. 26.

Denoted by 71 is a channel for selecting one of ⅓pulse 47, ⅓' pulse 49 and ⅓" pulse 50.

Denoted by 72 is a tone pulse delivered out of the channel 71.

Figure 38:
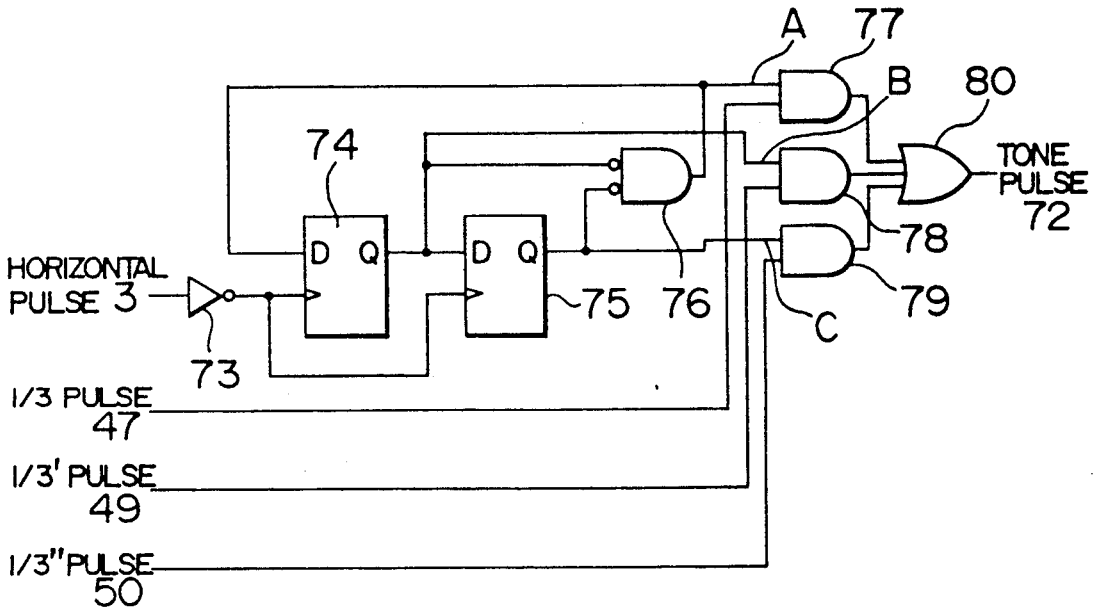
FIG. 38 is a circuit diagram of a channel 71.

FIG. 38 shows an internal circuit of channel 71 including a NOT circuit 73, D flip-flops 74 and 75, a NOR circuit 76, AND circuits 77 to 79 and an OR circuit 80.

Figure 39:
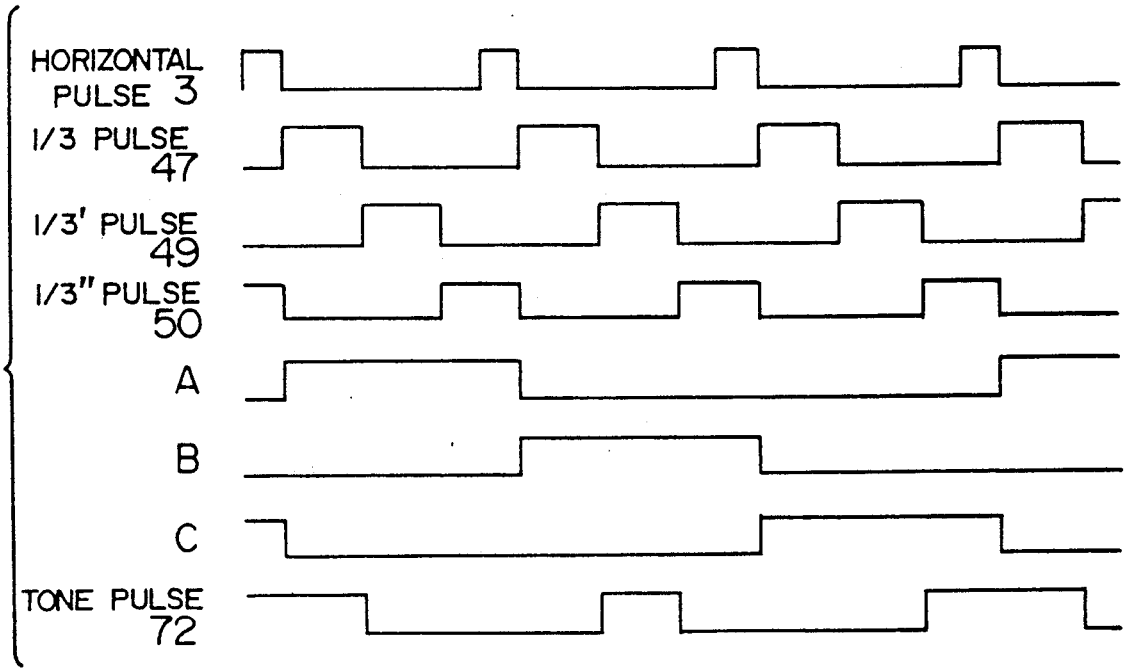
FIG. 39 is a timing chart for the channel 71.

FIG. 39 shows a timing chart for the channel 71.

Figure 40:
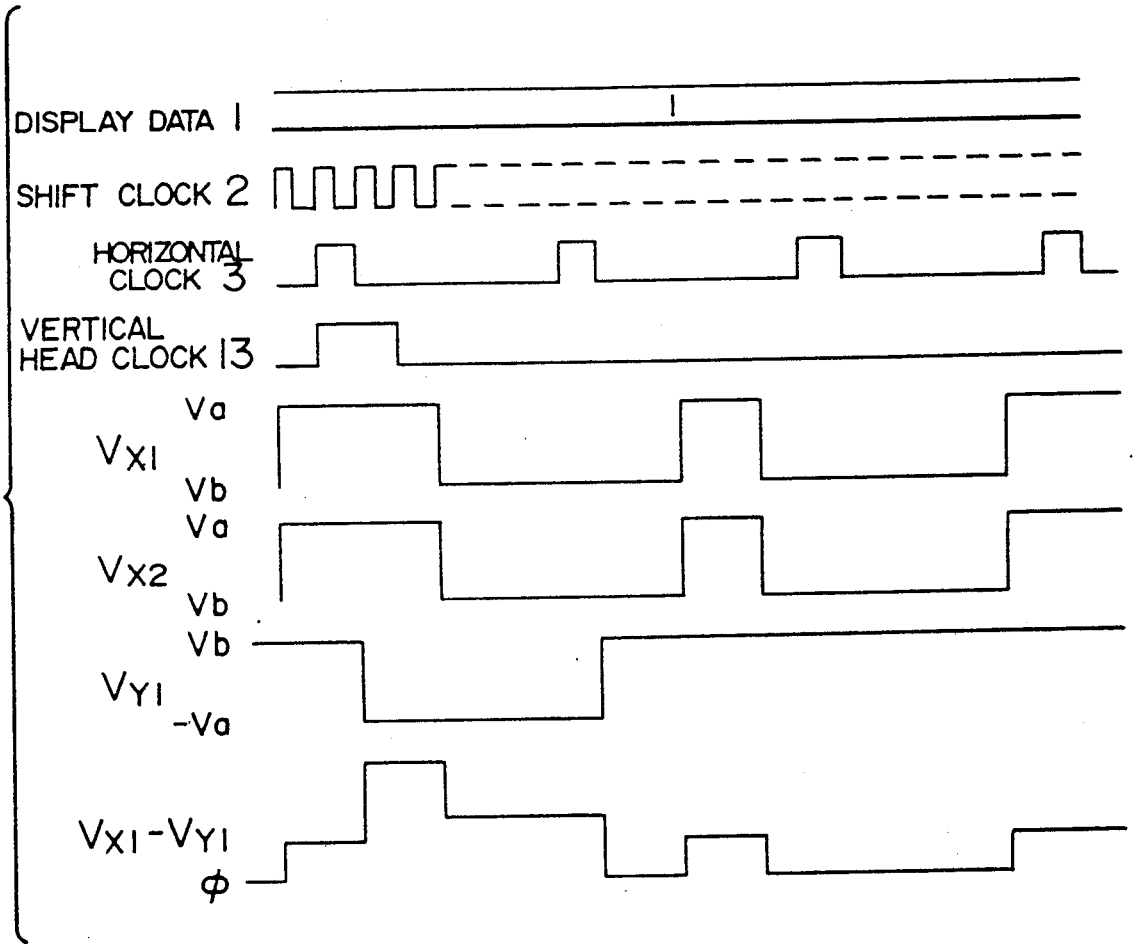
FIG. 40 is a timing chart for the FIG. 37 driving circuit.

FIG. 40 is a timing chart for the FIG. 37 driving circuit.

The operation of the FIG. 37 driving circuit will now be described with reference to FIG. 40.

As in FIG. 1, data pieces "1" of display data 1 are sequentially inputted and delivered as select signals 7.

A ⅓ pulse 47, a ⅓' pulse 49 and a ⅓" pulse 50 are generated similarly to FIG. 26.

The channel 71 constructed as shown in FIG. 38 responds to the fall of the horizontal clock 3 to repeat sequential delivery of ⅓ pulse 47, ⅓' pulse 49 and ⅓" pulse 50 as tone pulse 72, as shown in FIG. 39.

Then, the selector 11 receiving the select signals 7 delivers the tone pulses 72 as signals $X_l$ to $X_n$ of column selection signal 12 and the frequency of occurrence of voltage change edges of the column driving signals 19 can be decreased.

In this manner, noises induced in row driving signals can be suppressed to mitigate a decrease in brightness of display.

In the foregoing description, the manner of cancelling noises by using rise and fall edges of pulses and the manner of decreasing the number of pulse edges are separately applied to the respective embodiments. But the two manners may be used in combination to prevent a decrease in brightness of display as will be described with reference to FIGS. 41 to 44.

Figure 41:
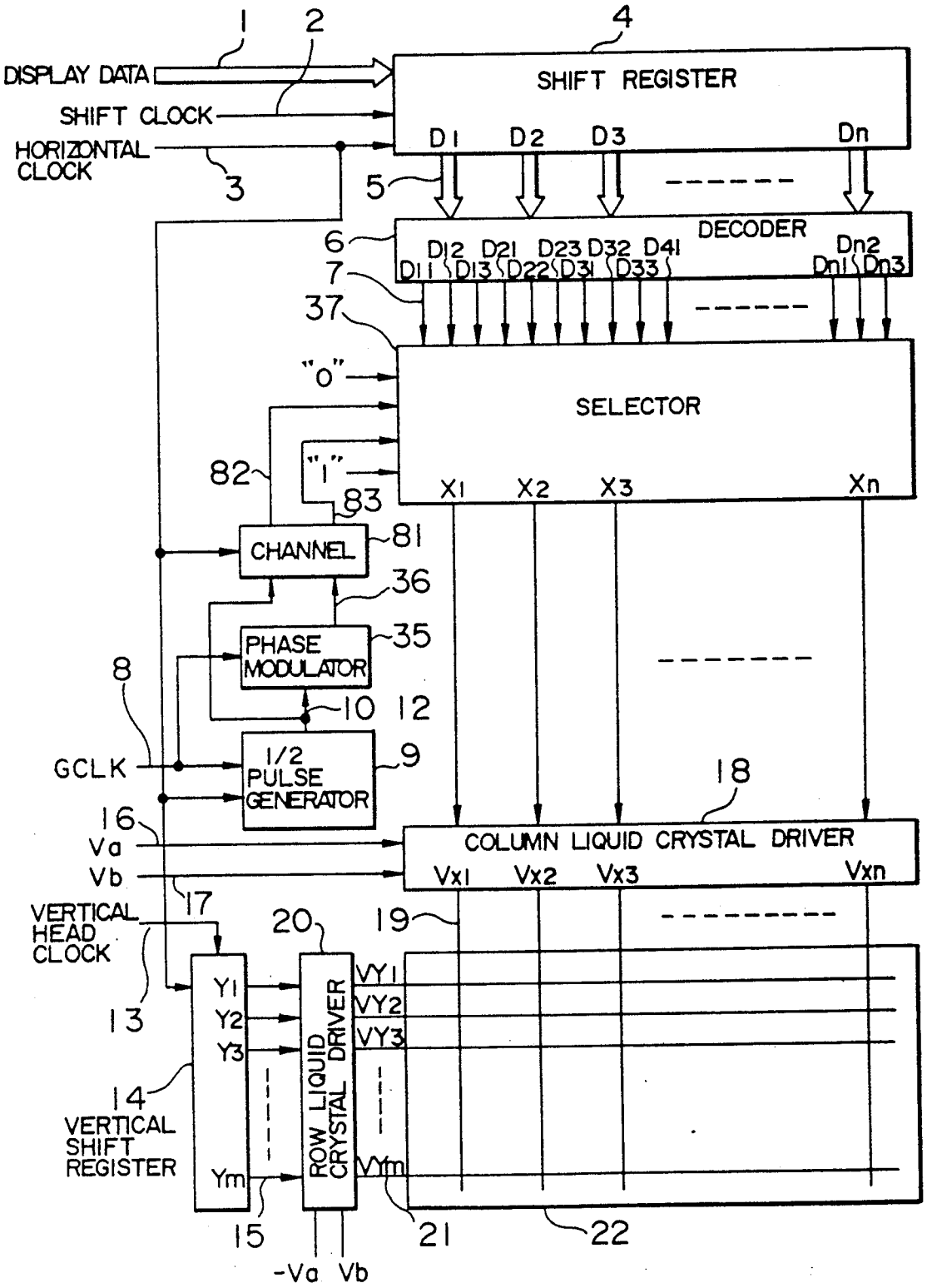
FIG. 41 is a block diagram illustrating still another embodiment of a half tone display driving circuit for a liquid crystal matrix panel according to the invention.

FIG. 41 illustrates still another embodiment of the driving circuit to this effect.

Reference numerals 1 to 10 and 12 to 22 designate the same components as those of FIG. 2.

Reference numeral 37 designates the same component as that of FIG. 1.

Denoted by 81 is a channel for switching a ½ pulse 10 and a ½' pulse 36.

The channel 81 delivers a first tone pulse 82 and a second tone pulse 83.

Figure 42:
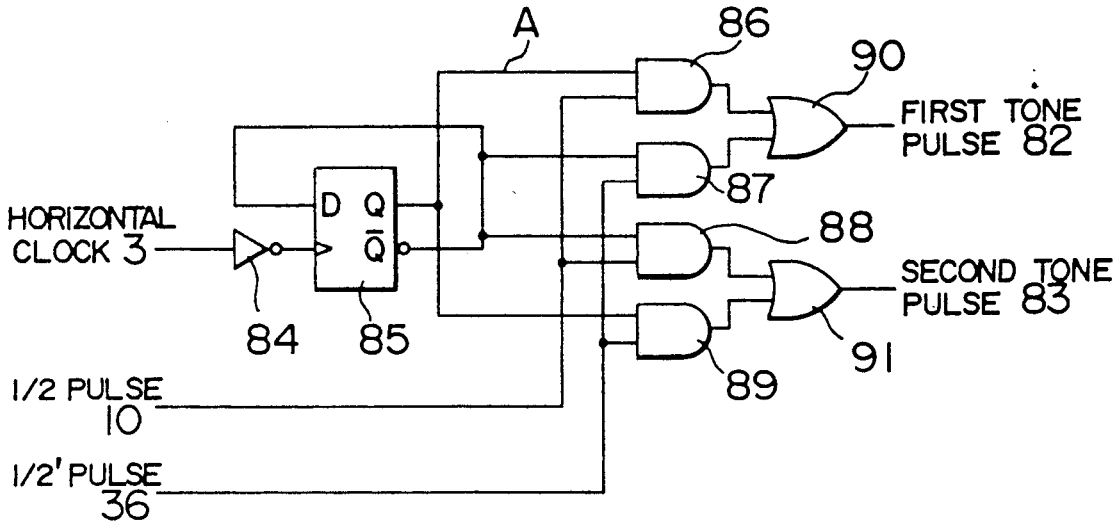
FIG. 42 is a circuit diagram of a channel 81.

FIG. 42 shows an internal circuit of channel 81 including a NOT circuit 84, a D flip-clop 85, AND circuits 86 to 89 and OR circuits 90 and 91.

Figure 43:
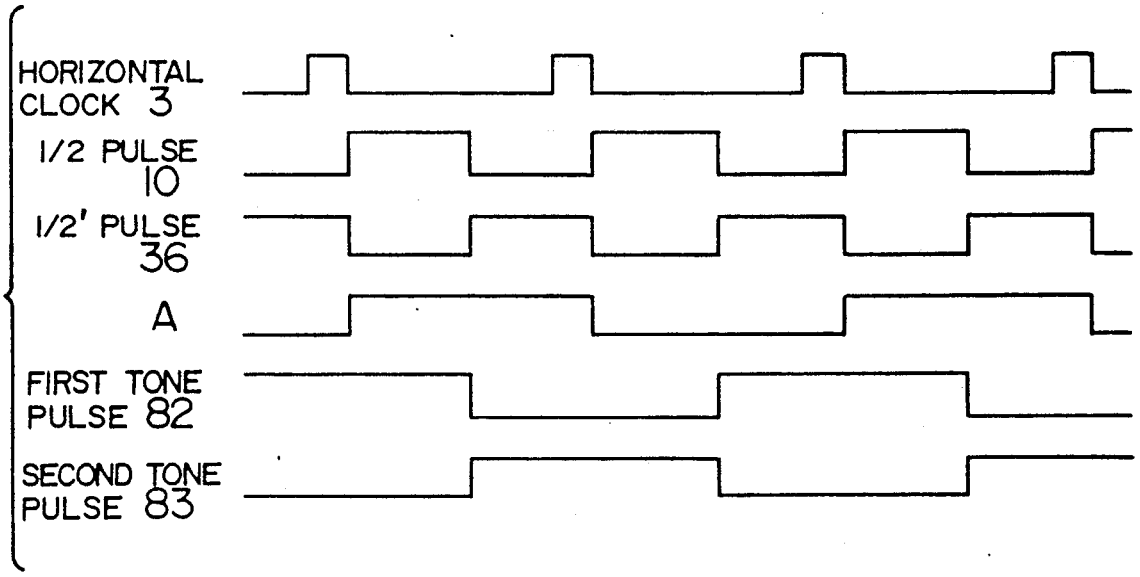
FIG. 43 is a timing chart for the channel 81.

FIG. 43 is a timing chart for the channel 81.

Figure 44:
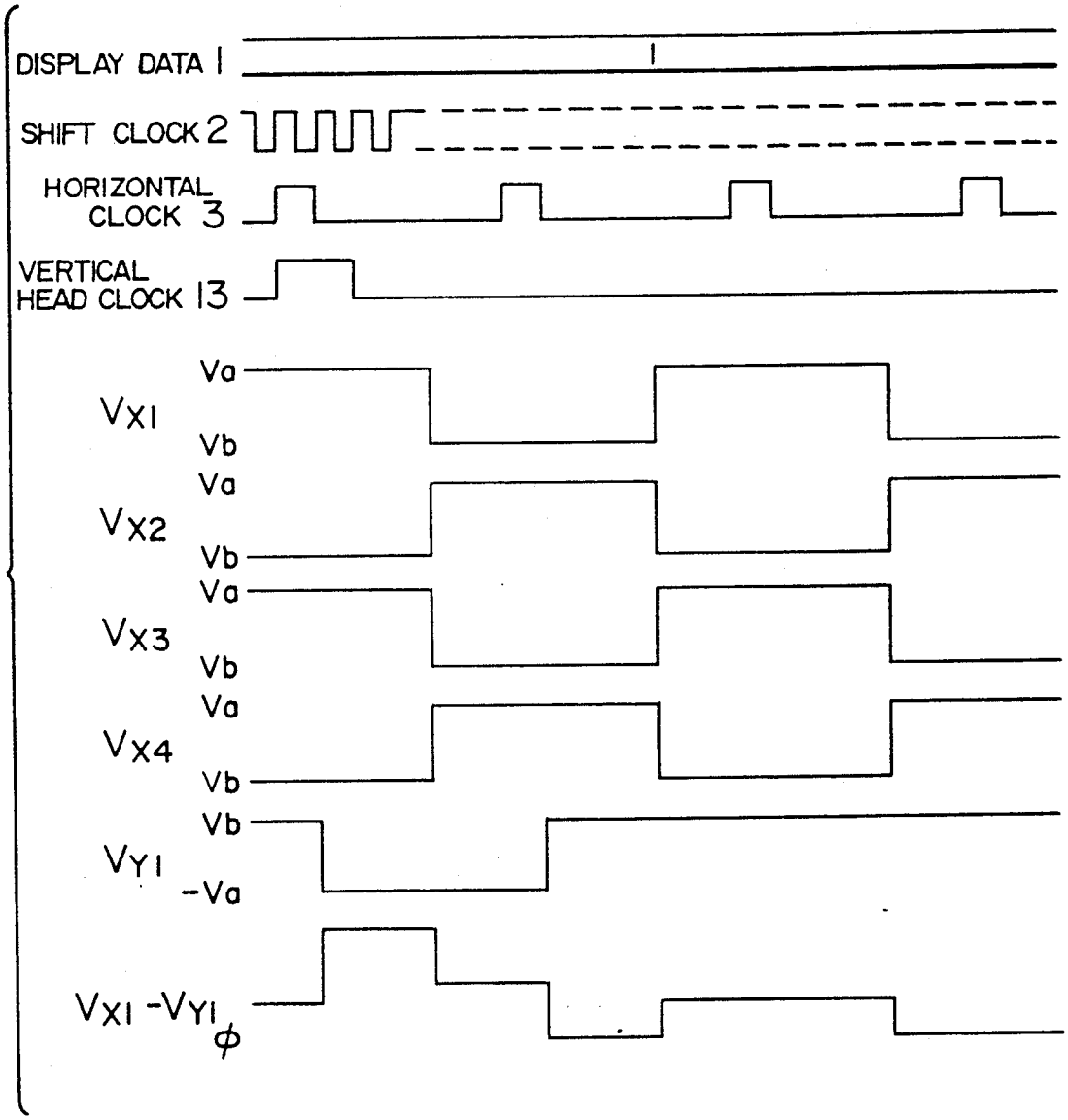
FIG. 44 is a timing chart for the FIG. 41 driving circuit.

FIG. 44 is a timing chart for the FIG. 41 driving circuit.

The operation of the FIG. 41 driving circuit will now be described with reference to FIG. 44.

As in the case of FIG. 1, data pieces "1" of display data 1 are sequentially inputted and delivered as select signals 7.

A ½ pulse 10 and a ½' pulse 36 are generated similarly to FIG. 1.

The channel 81 constructed as shown in FIG. 42 responds to the fall of the horizontal clock 3 to alternately switch the ½ pulse 10 and ½' pulse 36, thereby delivering the former pulse as the first tone pulse 82 and the latter pulse as the second tone pulse 83.

Then, the selector 37 receiving the select signals 7 delivers column selection signals 12 in which signals for odd columns are 180° out of phase relative to signals for even columns and the number of pulse edges is decreased, so that the column driving signals are produced having voltage waveforms wherein as shown in FIG. 44 voltage change edges for adjacent columns are rise edge and fall edge, respectively, and the number of edges is decreased.

In this manner, noises induced in row driving signals can be suppressed to eliminate or suppress a decrease in brightness of display.

As described above, according to the invention, the 1/n pulse for half tone display is subjected to signal processing and used for suppressing a decrease in brightness of display on the liquid crystal display screen. For example, in the present invention, even when the half tone display is effected over a wide area, a decrease in brightness of display on the liquid crystal display screen can be suppressed or eliminated to advantage owing to the suppression or elimination of noises induced in row driving signals.

Further, according to the present invention, a gray scale pulse (tone pulse) is generated on the basis of the half tone display 1/n pulse and the gray scale pulse (tone pulse) is used to decrease the frequency of occurrence of voltage edges, attaining effects similar to the above.

We claim:

1. A half tone display driving circuit for a liquid crystal panel, comprising:

a shift register for receiving display data and packeting data pieces at the rate of one horizontal period to deliver data pieces for each horizontal period;

a decoder for receiving the display data pieces for one horizontal period and decoding them to deliver decode signals representative of the data pieces;

1/n pulse generator means for generating a 1/n pulse the duration of which is 1/n of one horizontal period, where n is integer and $n \geqq 2$;

signal processor means for applying a pulse signal processing to said 1/n pulse delivered out of said 1/n pulse generator means and delivering a processed 1/n pulse signal;

a selector responsive to the decode signals representative of display data pieces delivered out of said decoder to select one of "1" signal, "0" signal, 1/n pulse delivered out of 1/n pulse generator means and processed 1/n pulse signal, for delivering a selected signal as output signal of said selector;

column liquid crystal driver means responsive to the selected output signal of said selector to select either one of two driving voltage values, for delivering a column driving signal; row liquid crystal driver means responsive to a row selection signal to select either one of two driving voltage values, for delivering a row driving signal; and a liquid crystal panel for receiving the column driving signal and the row driving signal to effect pixel display of liquid crystal matrix.

2. A half tone display driving circuit for a liquid crystal matrix panel according to claim 1 wherein said signal processor means comprises phase modulator means for applying to the 1/n pulse delivered out of said 1/n pulse generator means phase modulation ranging from 360/n degrees to $(n-1)\times 360/n$ degrees and delivering $(n-1)$ 1/n pulses subjected to the phase modulation ranging from 360/n degrees to $(n-1)\times 360/n$ degrees.

3. A half tone display driving circuit for a liquid crystal matrix panel according to claim 1 wherein said signal processor means comprises phase modulator means for applying to the 1/n pulse delivered out of said 1/n pulse generator means phase modulation ranging from 360/n degrees to $(n-1)\times 360/n$ degrees and delivering $(n-1)$ 1/n pulses subjected to the phase modulation ranging from 360/n degrees to $(n-1)\times 360/n$ degrees, and when half tone display is effected, said selector selects the 1/n pulse delivered out of said 1/n pulse generator means and the phase-modulated 1/n pulse delivered out of said signal processor means such that pulse signals for adjacent columns of said liquid crystal matrix panel respectively rise and fall at the same timing and delivers the selected 1/n pulse and phase-modulated 1/n pulses to said column liquid crystal driver means.

4. A half tone display driving circuit for a liquid crystal matrix panel according to claim 1 wherein said signal processor means comprises phase modulator means and a channel, for applying to the 1/n pulse delivered out of said 1/n pulse generator means phase modulation ranging from 360/n degrees to $(n-1)\times 360/n$ degrees and preparing n 1/n pulses subjected to the phase modulation ranging from zero degree to $(n-1)\times 360/n$ degrees, and preparing from the 1/n pulse and the phase-modulated 1/n pulses a gray scale pulse (tone pulse) in which the frequency of occurrence of voltage edges is decreased and delivering the tone pulse.

5. A half tone display driving circuit for a liquid crystal matrix panel according to claim 1 wherein said signal processor means comprises phase modulator means and a channel, for applying to the 1/n pulse delivered out of said 1/n pulse generator means phase modulation ranging from 360/n degrees to $(n-1)\times 360/n$ degrees and preparing n 1/n pulses subjected to the phase modulation ranging from zero degree to $(n-1)\times 360/n$ degrees, and preparing from the 1/n pulse and the phase modulated 1/n pulses a plurality of gray scale pulses (tone pulses) which are out of phase relative to each other and in which the frequency of occurrence of voltage edges is decreased, and when half tone display is effected, said selector selects the plurality of tone pulses delivered out of said signal processor means such that pulse signals for adjacent columns of said liquid crystal matrix panel rise and fall at the same timing, respectively, and delivers the selected gray scale pulses (tone pulses) to said column liquid crystal driver means.

6. A half tone display driving circuit for a liquid crystal matrix panel according to claim 1 wherein $n=2$.

7. A half tone display driving circuit for a liquid crystal matrix panel according to claim 1 wherein $n=3$.

8. A half tone display method for a liquid crystal matrix panel comprising:

a first step of fetching display data for one horizontal period and decoding the display data to deliver decode signals representative of data pieces of the display data;

a second step of generating a 1/n pulse the duration of which is 1/n of one horizontal period, where n is integer and $n>2$;

a third step of applying a pulse signal processing to said 1/n pulse and delivering a processed 1/n pulse signal;

a fourth step of selecting one of "1" signal, "0" signal, 1/n pulse generated in said second step and processed 1/n pulse generated in said third step, on the basis of the decode signals generated in said first step and delivering a selected signal as column liquid crystal driving signal;

a fifth step of generating a row liquid crystal driving signal on the basis of a horizontal clock; and a sixth step of driving said liquid crystal matrix panel for display on the basis of the column liquid crystal driving signal and the row liquid crystal driving signal.

9. A half tone display method for a liquid crystal matrix panel according to claim 8 wherein the signal processing in said third step is applying to the 1/n pulse generated in said second step phase modulation ranging from 360/n degrees to $(n-1)\times 360/n$ degrees.

10. A half tone display method for a liquid crystal matrix panel according to claim 8 wherein the signal processing in said third step is applying to the 1/n pulse generated in said second step phase modulation ranging from 360/n degrees to $(n-1)\times 360/n$ degrees, and in said fourth step, the 1/n pulse generated in said second step and the phase-modulated 1/n pulse generated in said third step are selected when half tone display is effected such that pulse signals for adjacent columns of said liquid crystal matrix panel respectively rise and fall at the same timing and the selected 1/n pulse and phase-modulated 1/n pulse are delivered.

11. A half tone display method for a liquid crystal matrix panel according to claim 8 wherein the signal processing in said third step is applying to the 1/n pulse generated in said second step phase modulation ranging from 360/n degrees to $(n-1)\times 360/n$ degrees and preparing from the 1/n pulse and the phase-modulated 1/n pulses a gray scale pulse (tone pulse) in which the frequency of occurrence of voltage edges is decreased.

12. A half tone display method for a liquid crystal matrix panel according to claim 8 wherein the signal processing in said third step is applying to the 1/n pulse generated in said second step phase modulation ranging from 360/n degrees to $(n-1)\times 360/n$ degrees and preparing from the 1/n pulse and the phase modulated 1/n pulses a plurality of gray scale pulses (tone pulses) which are out of phase relative to each other and in which the frequency of occurrence of voltage edges is decreased, and in said fourth step, the plurality of gray scale pulses (tone pulses) generated in said third step are selected when half tone display is effected such that pulse signals for adjacent columns of said liquid crystal matrix panel rise and fall at the same timing, respectively, and the selected gray scale pulses (tone pulses) are delivered.

13. A half tone display method for a liquid crystal matrix panel according to claim 8 wherein $n=2$.

14. A half tone display method for a liquid crystal matrix panel according to claim 8 wherein $n=3$.

* * * * *

UNITED STATES PATENT AND TRADEMARK OFFICE

CERTIFICATE OF CORRECTION

PATENT NO. : 5,038,139

DATED : August 6, 1991

INVENTOR(S) : FUJISAWA, et al

It is certified that error appears in the above-identified patent and that said Letters Patent is hereby corrected as shown below:

ON THE TITLE PAGE

[73] Hitachi, Ltd., Japan, and Hitachi Video Engineering, Incorporated, Japan

Signed and Sealed this

Twentieth Day of December, 1994

*Attest:*

Bruce Lehman

BRUCE LEHMAN

*Attesting Officer*

*Commissioner of Patents and Trademarks*